US005200307A

United States Patent [19]

Takahashi

[11] Patent Number: 5,200,307

[45] Date of Patent: Apr. 6, 1993

[54] SLIVER HALIDE COLOR PHOTOGRAPHIC MATERIAL

[75] Inventor: Osamu Takahashi, Minami-ashigara, Japan

[73] Assignee: Fuji Photo Film Co., Ltd., Kanagawa, Japan

[21] Appl. No.: 767,680

[22] Filed: Sep. 30, 1991

[30] Foreign Application Priority Data

Oct. 2, 1990 [JP] Japan ..... 2-264446

[51] Int. Cl.[5] ..... G03C 1/815; G03C 7/388

[52] U.S. Cl. ..... 430/507; 430/558; 430/931; 430/512; 430/546; 430/377

[58] Field of Search ..... 430/512, 546, 377, 507, 430/386, 387, 558, 931

[56] References Cited

U.S. PATENT DOCUMENTS

| | | | |
|---|---|---|---|
| 3,679,630 | 7/1972 | Corson et al. . | |
| 3,725,067 | 4/1973 | Bailey et al. . | |
| 3,782,952 | 1/1974 | Golda et al. . | |
| 4,239,851 | 12/1980 | Aoki et al. | 430/546 |
| 4,247,627 | 1/1981 | Chen | 430/512 |
| 4,540,657 | 9/1985 | Krishnamurthy | 430/546 |
| 4,865,957 | 9/1989 | Sakai et al. | 430/512 |
| 4,865,963 | 9/1989 | Furutachi et al. | 430/512 |

FOREIGN PATENT DOCUMENTS

| | | |
|---|---|---|
| 0280238 | 8/1988 | European Pat. Off. . |
| 60-96618 | 5/1985 | Japan . |
| 63-264748 | 11/1988 | Japan . |
| 1-172417 | 7/1989 | Japan . |

*Primary Examiner*—Charles L. Bowers, Jr.
*Assistant Examiner*—Mark F. Huff
*Attorney, Agent, or Firm*—Birch, Stewart, Kolasch & Birch

[57] ABSTRACT

A silver halide color photographic material containing a support having thereon photographic constitutional layers, which comprises (a) a magenta coupler represented by formula (I) that is contained with a high-boiling organic solvent at a prescribed weight ratio in a magenta coupler containing layer, and (b) a ultraviolet absorbing agent represented by formula (II) that is contained with a hydrophobic polymer in a non-photosensitive layer located at a position farther than a cyan coupler containing emulsion layer for the base:

Formula (I)

wherein $R_1$ represents a hydrogen atom or a substituent, $Z_a$, $Z_b$, and $Z_c$ each represent a methine, substituted methine, =N—, or —NH—, Y represents a hydrogen atom or a group capable of being released upon a coupling reaction with the oxidized product of a developing agent, and the compound may form a dimer or higher polymer through $R_1$, Y, or $Z_a$, $Z_b$, or $Z_c$, that is a substituted methine, Formula (II)

wherein $R_2$, $R_3$, and $R_4$ each represent a hydrogen atom, a halogen atom, a nitro group, a hydroxyl group, an alkyl group, an alkoxy group, an aryl group, an aryloxy group, an alkenyl group, or an acylamino group.

15 Claims, No Drawings

SLIVER HALIDE COLOR PHOTOGRAPHIC MATERIAL

FIELD OF THE INVENTION

The present invention relates to silver halide color photographic materials, and particularly to a color photographic material that can provide a color print remarkably fine in fastness of the image to light, even under a wide variety of light sources regardless of the type of light source. More particularly the present invention relates to a silver halide color photographic material that can provide a color print conspicuously fine in fastness of the three colors; yellow, magenta, and cyan, to the same extent.

BACKGROUND OF THE INVENTION

As a method for forming dyes by using a silver halide color photographic material, a method is mentioned wherein photographic couplers and the oxidized product of a color-developing agent are reacted to form dyes, and as photographic couplers for the usual color reproduction, magenta, yellow, and cyan couplers are used, and as a color-developing agent, an aromatic primary amine color-developing agent is used. The reactions of a magenta coupler and a yellow coupler with the oxidized product of an aromatic primary amine color-developing agent form dyes such as azomethine dyes, and the reaction of a cyan coupler with the oxidized product of an aromatic primary amine color developing agent forms a dye such as an indoaniline dye.

Couplers employed for forming yellow dye images include, for example, acylacetanilide couplers; couplers for forming magenta dye images include, for example, pyrazolone, pyrazolobenzimidazole, pyrazolotriazole, or indazolone couplers, and as couplers for forming cyan dye images, for example, phenol or naphthol couplers are generally employed.

In particular, couplers widely used for forming magenta dye images are 5-pyrazolones. The dyes formed from these couplers have subsidiary absorption near 430 nm in addition to the main absorption near 550 nm, and this subsidiary absorption of a yellow component causes color contamination, which has been a serious problem in view of color reproduction. Further, in the case of magenta couplers, the degree of yellow stain caused by the decomposition of the coupler remaining in the color unformed part by light, heat, and humidity is quite high in comparison with those of cyan and yellow couplers, this yellow stain has been a defect in view of the improvement in image preservability.

As magenta couplers improved in yellow stain as well as the above subsidiary absorption of a yellow component, pyrazolotriazole couplers described in U.S. Pat. No. 3,725,067, JP-A ("JP-A" means unexamined published Japanese patent application) Nos. 99437/1984, 162548/1984, and 171956/1984, and *Research Disclosure* Nos. 24,220, 24,230, and 24,531 are particularly fine.

The dyes formed from pyrazolotriazole magenta couplers described in these publications are good in color reproduction and are high in stability to heat and moist heat, since the subsidiary absorption near 430 nm is considerably smaller than that of the dyes formed from the above-mentioned 5-pyrazolones having an anilino group in the 3-position. In addition they have quite favorable performance, since the formation of yellow stain in the color unformed part caused by light, heat, and moist heat is quite small.

The dyes formed from the above-mentioned pyrazolotriazole magenta couplers have fine properties as described above, and these fine properties are exhibited particularly well when they are applied in color print papers.

On the other hand, there are two major performances expected for color print papers: 1. the obtained color image should be fine in color reproduction, and 2. the obtained color image should last for a long time as it is.

Therefore, in comparison with color print paper wherein conventionally 5-pyrazolones are used, color print paper wherein the above-mentioned pyrazolotriazole magenta couplers are introduced is fine in color reproduction and the obtained image is hardly changed by heat or moist heat, so that it can be said that the performances thereof have come near the above expected ideal performances. However, although the dark-fading (a change in the color image when it was kept in dark, such in an album) of the color print is indeed improved considerably, further progress in the stability of the color print to light is expected. In this case, particularly in order to make a person who observes the image feel that the color image does not change permanently, of course each of yellow, magenta, and cyan should undergo as little light-fading as possible, and at the same time it is also important that the extent of the light-fading of the yellow, magenta, and cyan dyes are almost the same regardless of the light source and the period of the exposure to light. That is, if the extent of the light-fading of yellow, magenta, and cyan are different and the color balance is lost, the image quality drops extremely.

SUMMARY OF THE INVENTION

The object of the present invention is to provide a silver halide photographic material whose image is strikingly less deteriorated by exposure to light because the color reproduction is fine and the light-fastness of the yellow, the light-fastness of the magenta, and the light-fastness of the cyan are well balanced and are fine regardless of the light source and the period of exposure to light.

The above and other objects, features, and advantages of the invention will be apparent more fully from the following description.

DETAILED DESCRIPTION OF THE INVENTION

The above object of the present invention has been attained by taking the following technical means.

(1) A silver halide color photographic material containing a support having thereon photographic constitutional layers comprising a silver halide emulsion layer containing a yellow coupler, a silver halide emulsion layer containing a magenta coupler, and a silver halide emulsion layer containing a cyan coupler as well as non-photosensitive layers, which comprises (a) in said magenta coupler containing layer, at least one magenta coupler represented by formula (I) given below, the ratio of the weight (A) of the high-boiling organic solvent contained in said magenta coupler containing silver halide emulsion layer to the weight (B) of said magenta coupler (A/B) being between 4.5 and 6.0, and (b) in a non-photosensitive layer located at a position farther than the cyan coupler containing emulsion layer from the base, at least one ultraviolet absorbing agent represented by formula (II) given below and a hydrophobic polymer in such a state that they are present together in lipophilic particles:

Formula (I)

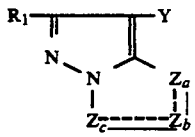

wherein $R_1$ represents a hydrogen atom or a substituent, $Z_a$, $Z_b$, and $Z_c$ each represent a methine, substituted methine, =N—, or —NH—, Y represents a hydrogen atom or a group capable of being released upon a coupling reaction with the oxidized product of a developing agent, and the compound may form a dimer or higher polymer through $R_1$, Y, or $Z_a$, $Z_b$, or $Z_c$, when it is a substituted methine, Formula (II)

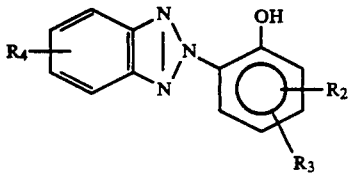

wherein $R_2$, $R_3$, and $R_4$ each represent a hydrogen atom, a halogen atom, a nitro group, a hydroxy group, an alkyl group, an alkoxy group, an aryl group, an aryloxy group, an alkenyl group, or an acylamino group.

(2) A silver halide color photographic material as stated under (1), wherein said silver halide emulsion layer containing a yellow coupler contains at least one compound selected from the group consisting of sparingly water-soluble epoxy compounds represented by the following formulae (III), (IV), and (V), Formula (III)

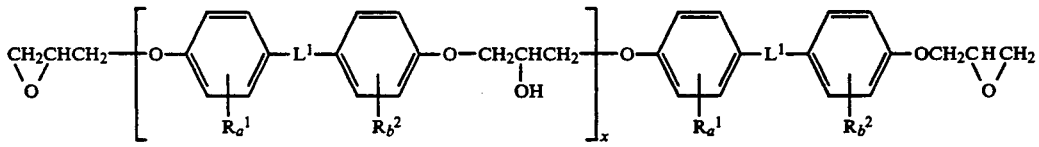

Formula (IV)

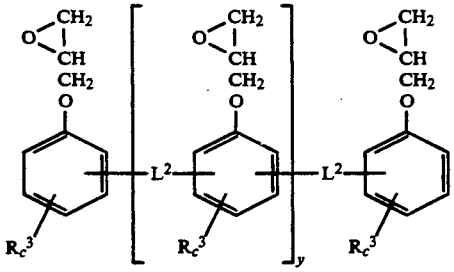

Formula (V)

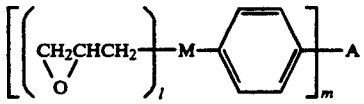

wherein $R^1$, $R^2$, and $R^3$ each represent an alkyl group or a halogen atom, $L^1$ and $L^2$ each represent a divalent aliphatic organic group, M represents an oxygen atom or a nitrogen atom, A represents a polyvalent linking group, a, b, and c each are an integer of 0 to 4, x and y each are a real number of 0 to 20, l is 1 or 2, and m is an integer of 2 to 4.

The magenta coupler represented by formula (I) will now be described below in detail.

Specific examples of the substituent represented by $R_1$ of formula (I) and specific examples of the substituent of the substituted methine group represented by $Z_a$, $Z_b$, and $Z_c$ of formula (I) include typically an alkyl group, an alkoxy group, an aryl group, an aryloxy group, and those formed by bonding a further substituent to them. Details of these substituents are described in the specification of U.S. Pat. No. 4,540,654, second column, line 41 to eighth column, line 27.

As the group (including atom) capable of being released upon coupling reaction represented by Y, those of a type wherein the release occurs at a halogen atom, asulfur atom, an oxygen atom, or a nitrogen atom are preferable, with a halogen atom and an arylthio group being particularly preferred.

Preferably, one of the $Z_a$–$Z_b$ bond and the $Z_b$–$Z_c$ bond is a double bond and the other is a single bond. If the $Z_b$–$Z_c$ bond is a carbon-carbon double bond, it includes the case wherein it is a part of an aromatic ring.

Among the pyrazoloazole couplers represented by formula (I), imidazo[1,2-b]pyrazoles described in U.S. Pat. No. 4,500,630 are preferable, with pyrazolo[1,5,b][1,2,4]triazoles described in U.S. Pat. No. 4,540,654 particularly preferred, because of the small yellow subsidiary absorption and the light-fastness of the color-formed dye.

Further, the use of pyrazolotriazole couplers wherein a branched alkyl group is directly attached to the 2-, 3-, or 6-position of the pyrazolotriazole ring, as described in JP-A No. 65245/1986, pyrazoloazole couplers containing a sulfonamido group in the molecule, as described in JP-A No. 65246/1986, pyrazoloazole couplers having an alkoxyphenylsulfonamido ballast group, as described in JP-A No. 147254/1986, and pyrazoloazole couplers having an alkoxy group or an aryloxy group in the 6-position, as described in European Patent (publication) Nos. 226,849 and 294,785, is preferable.

Some preferable specific examples of the magenta coupler represented by formula (I) are shown below, but the present invention is not restricted to them.

| Compound | $R_{10}$ | $R_{11}$ | Y |
|---|---|---|---|
| | | 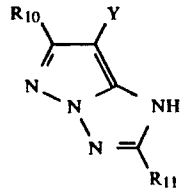 | |
| I-1 | $CH_3$— | 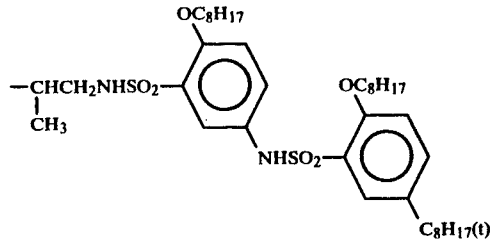 | Cl |
| I-2 | $CH_3$— | 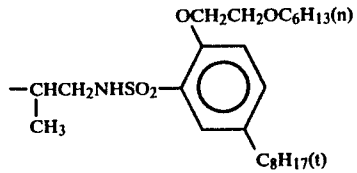 | Cl |
| I-3 | $(CH_3)_3C$— | 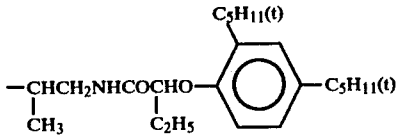 | 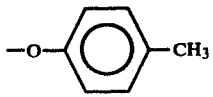 |
| I-4 | 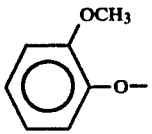 | 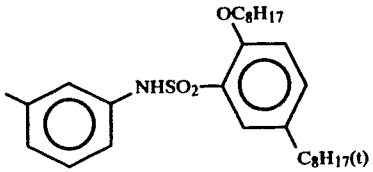 | 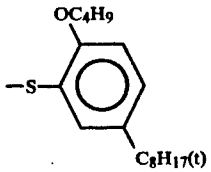 |

-continued
| Compound | $R_{10}$ | $R_{11}$ | Y |
|---|---|---|---|
| I-5 | $CH_3$— | 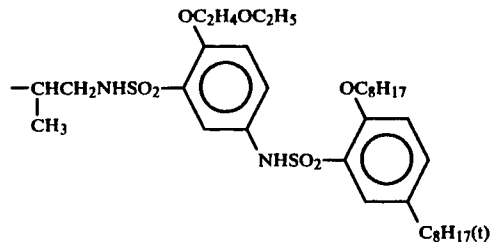 | Cl |
| I-6 | $CH_3$— | 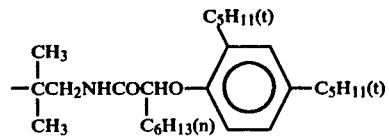 | Cl |
| I-7 | $CH_3$— | 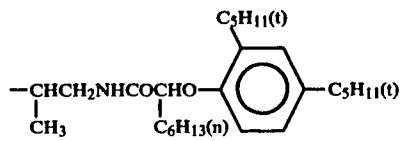 | Cl |
| I-8 | $CH_3$— | 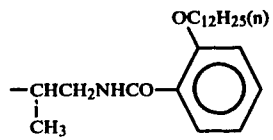 | Cl |
| I-9 | $CH_3$— | 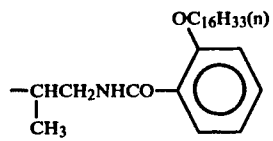 | Cl |

-continued
| Compound | $R_{10}$ | $R_{11}$ | Y |
|---|---|---|---|
| I-10 | 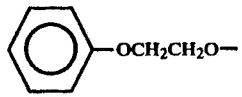 | 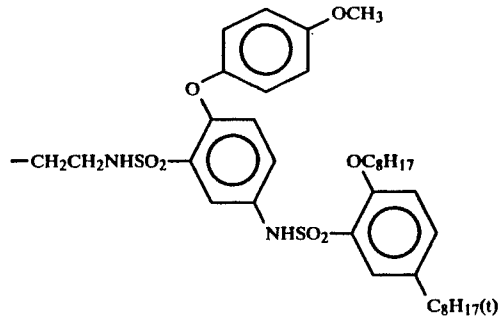 | 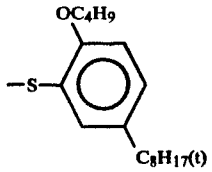 |
| I-11 | $CH_3CH_2O-$ | The same as the above | The same as the above |
| I-12 | 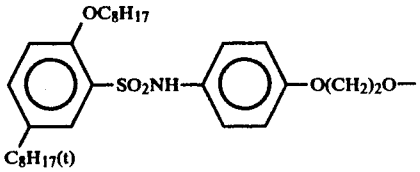 | 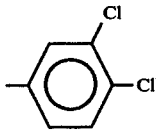 | 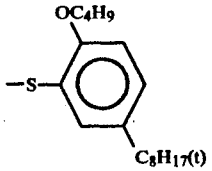 |
| I-13 | 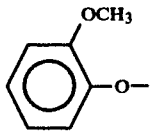 | 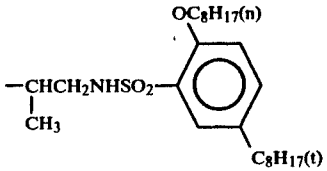 | Cl |
| | 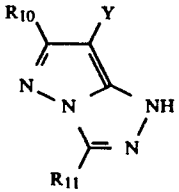 | | |
| I-14 | $CH_3-$ | 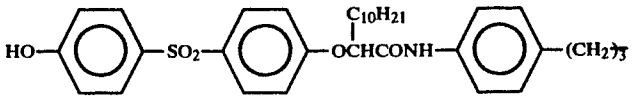 | Cl |

-continued

| Compound | $R_{10}$ | $R_{11}$ | Y |
|---|---|---|---|
| I-15 | $CH_3$— | $(n)C_6H_{19}$ \ $CHCH_2SO_2$—$(CH_2)_{\overline{2}}$ / $(n)C_8H_{17}$ | Cl |
| I-16 | $CH_3$ \ CH— / $CH_3$ | $OC_4H_9$; $SO_2$—$(CH_2)_{\overline{3}}$; $C_8H_{17}(t)$ | Cl |
| I-17 | —$(CH$—$CH_2)_{\overline{50}}$—$(CH_2$—$C)_{\overline{50}}$— ($CH_3$; $COOCH_2CH_2OCH_3$; CONH—) | $CH_3$—CH— ($CH_2NHSO_2CH_3$) | Cl |
| I-18 | —O— | $OC_8H_{17}$; —$(CH_2)_2NHSO_2$—; $C_8H_{17}(t)$ | Cl |
| I-19 | $CH_3$— | $CH_3$; $CH_3$; $CH_3$; NHCOCHO—($(n)C_{10}H_{21}$); $SO_2$; $OCH_2$ | Cl |
| I-20 | $(CH_3)_3C$— | $CH_3$; $CH_3$; $CH_3$; $C_5H_{11}(t)$; NHCOCHO—($C_4H_9(n)$); $C_5H_{11}(t)$ | Cl |

-continued
| Compound | $R_{10}$ | $R_{11}$ | Y |
|---|---|---|---|
| I-21 | 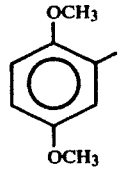 | 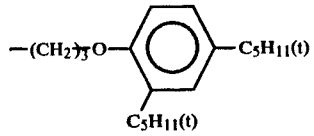 | Cl |
| I-22 | $CH_3$— | $-CH(C_2H_5)-N(C_{18}H_{37}(n))COCH_2CH_2COOH$ | Cl |

The magenta coupler represented by formula (I) is contained in the silver halide emulsion in an amount of 0.1 to 1.0 mol, preferably 0.20 to 0.5 mol, per mol of the silver halide.

The ultraviolet-absorbing agent of the present invention represented by formula (II) is preferably one wherein $R_4$ is an electron-attractive group, and it is preferably a liquid at room temperature, because in that case, for example, a high-boiling organic solvent is not additionally required.

Further, a UV-absorbing agent other than those represented by formula (II), such as UV-absorbing agents described in JP-A No. 73032/1979, may be additionally used, and also two or more compounds of the present invention may be used in combination. Further, a high-boiling organic solvent and other additives may also be present.

The coating amount of the ultraviolet-absorbing agent of the present invention contained in the non-photosensitive layer is preferably 0.1 to 1.0 g/m$^2$, particularly preferably 0.2 to 0.7 g/m$^2$.

The weight ratio of the UV-absorbing agent to the hydrophobic polymer is from 0.1 to 20, more preferably from 0.5 to 10.

Some preferable specific examples of the ultraviolet-absorbing agent represented by formula (II) are shown below, but the present invention is not restricted to them.

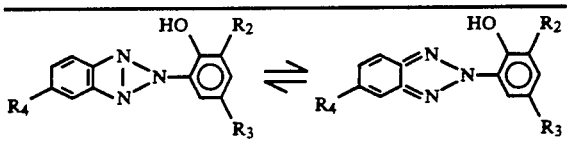

| U V No. | $R_4$ | $R_2$ | $R_3$ |
|---|---|---|---|
| II-1 | H | H | H |
| II-2 | H | H | $CH_3$ |
| II-3 | H | H | $C_4H_9$(t) |
| II-4 | H | H | $C_5H_{11}$(t) |
| II-5 | H | H | $C_6H_5$ |
| II-6 | H | H | $C_6H_{11}$ |
| II-7 | H | H | $C_8H_{17}$(n) |
| II-8 | H | H | $C_8H_{17}$(i) |
| II-9 | H | H | $C_8H_{17}$(t) |
| II-10 | H | H | $C_{12}H_{25}$(n) |
| II-11 | H | H | $C_{16}H_{33}$(n) |
| II-12 | H | H | $OCH_3$ |
| II-13 | H | H | $CH_2CH_2COOC_8H_{17}$ |
| II-14 | H | $CH_3$ | $C_4H_9$(sec) |
| II-15 | H | $CH_3$ | $C_4H_9$(t) |
| II-16 | H | $C_4H_9$(sec) | $C_4H_9$(sec) |
| II-17 | H | $C_4H_9$(sec) | $C_4H_9$(t) |
| II-18 | H | $C_4H_9$(t) | $C_4H_9$(sec) |
| II-19 | H | $C_4H_9$(t) | $C_4H_9$(t) |
| II-20 | H | $C_4H_9$(t) | $C_{12}H_{25}$(sec) |
| II-21 | H | $C_4H_9$(t) | $CH_2CH_2COOC_8H_{17}$ |
| II-22 | H | $C_5H_{11}$(t) | $C_5H_{11}$(t) |
| II-23 | H | $C_5H_{11}$(t) | $C_6H_5$ |
| II-24 | H | $C_5H_{11}$(t) | $CH_2C_6H_5$ |
| II-25 | H | Cl | Cl |
| II-26 | Cl | H | $C_5H_{11}$(t) |
| II-27 | Cl | H | $C_6H_5$ |
| II-28 | Cl | H | $C_6H_{11}$ |
| II-29 | Cl | H | $CH_2CH_2COOC_8H_{19}$ |
| II-30 | Cl | H | Cl |
| II-31 | Cl | $C_4H_9$(sec) | $C_4H_9$(sec) |
| II-32 | Cl | $C_4H_9$(sec) | $C_4H_9$(t) |
| II-33 | Cl | $C_4H_9$(t) | $CH_3$ |
| II-34 | Cl | $C_4H_9$(t) | $CH_2CH{=}CH_2$ |
| II-35 | Cl | $C_4H_9$(t) | $C_4H_9$(sec) |
| II-36 | Cl | $C_4H_9$(t) | $C_4H_9$(t) |
| II-37 | Cl | $C_4H_9$(t) | $C_6H_{11}$ |
| II-38 | Cl | $C_4H_9$(t) | $CH_2CH_2COOC_8H_{17}$ |
| II-39 | Cl | $C_5H_{11}$(n) | $C_6H_5$ |

-continued

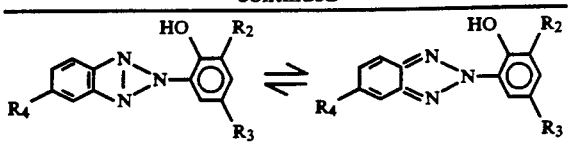

| U V No. | $R_4$ | $R_2$ | $R_3$ |
|---|---|---|---|
| II-40 | $CH_3$ | H | $C_8H_{17}$(t) |
| II-41 | $CH_3$ | H | —$OCH_3$ |
| II-42 | $CH_3$ | $C_4H_9$(sec) | $C_4H_9$(sec) |
| II-43 | $CH_3$ | $C_4H_9$(sec) | $C_4H_9$(t) |
| II-44 | $CH_3$ | $C_5H_{11}$(t) | $OC_6H_5$ |
| II-45 | $CH_3$ | Cl | $C_8H_{17}$(n) |
| II-46 | $C_2H_5$ | $C_3H_7$(t) | $C_3H_7$(t) |
| II-47 | $C_4H_9$(n) | $C_4H_9$(sec) | $C_4H_9$(sec) |
| II-48 | $C_4H_9$(n) | $C_4H_9$(sec) | $C_4H_9$(t) |
| II-49 | $C_4H_9$(n) | $C_4H_9$(sec) | $C_5H_{11}$(t) |
| II-50 | $C_4H_9$(sec) | $C_4H_9$(t) | $C_4H_9$(t) |
| II-51 | $C_4H_9$(sec) | $C_4H_9$(t) | $C_5H_{11}$(t) |
| II-52 | $C_4H_9$(sec) | $C_4H_9$(t) | $CH_2CH_2COOC_8H_{17}$ |
| II-53 | $C_4H_9$(sec) | $C_5H_{11}$(t) | $C_5H_{11}$(t) |
| II-54 | $C_4H_9$(t) | $C_4H_9$(sec) | $C_4H_9$(sec) |
| II-55 | $C_4H_9$(t) | $C_4H_9$(sec) | $C_4H_9$(t) |
| II-56 | $C_4H_9$(t) | $C_4H_9$(sec) | $C_5H_{11}$(t) |
| II-57 | $C_4H_9$(t) | $C_4H_9$(t) | $C_4H_9$(t) |
| II-58 | $C_5H_{11}$(n) | $C_4H_9$(sec) | $C_4H_9$(t) |
| II-59 | $C_5H_{11}$(t) | $C_4H_9$(sec) | $C_4H_9$(t) |
| II-60 | $C_5H_{11}$(t) | $C_5H_{11}$(t) | $C_5H_{11}$(t) |
| II-61 | $C_6H_5$ | $C_4H_9$(t) | $C_4H_9$(t) |
| II-62 | $C_6H_5$ | $C_5H_{11}$(t) | $C_5H_{11}$(t) |
| II-63 | $C_8H_{17}$(n) | H | $C_8H_{17}$(n) |
| II-64 | CH | $C_4H_9$(t) | $C_4H_9$(t) |
| II-65 | $OCH_3$ | H | $OC_8H_{17}$(sec) |
| II-66 | $OCH_3$ | $C_4H_9$(sec) | $C_4H_9$(sec) |
| II-67 | $OCH_3$ | $C_4H_9$(sec) | $C_4H_9$(t) |
| II-68 | $OCH_3$ | $C_5H_{11}$(t) | $C_5H_{11}$(t) |
| II-69 | $OCH_3$ | $C_5H_{11}$(t) | $C_6H_5$ |
| II-70 | $OCH_3$ | Cl | Cl |
| II-71 | $OC_2H_5$ | $C_4H_9$(sec) | $C_4H_9$(t) |
| II-72 | $OC_4H_9$(n) | Cl | $OCH_3$ |
| II-73 | $OC_6H_5$ | $C_5H_{11}$(t) | $C_5H_{11}$(t) |
| II-74 | $COOC_4H_9$(n) | $C_4H_9$(n) | $C_5H_{11}$(t) |
| II-75 | $NO_2$ | $C_8H_{17}$(n) | $OCH_3$ |

As the method for preparing lipophilic fine particles wherein the ultraviolet-absorbing agent and the hydrophobic polymer of the present invention are present together, for example, a method described in British Patent No. 2,016,017A, wherein polymer particles are previously prepared (a loadable latex) and thereafter the latex is impregnated with an ultraviolet-absorbing agent, and a method described in JP-A No. 264748/1988, wherein a hydrophobic mixed liquid in which an ultraviolet-absorbing agent and a polymer insoluble in water but soluble in an organic solvent are dissolved together is emulsified and dispersed, can be mentioned. In the present invention, a particularly preferable method for the dispersion is the method described in JP-A No. 264748/1988, because the type of polymer together with which the ultraviolet absorbing agent will be caused to be present can be selected from a wide variety of polymers, and also the ultraviolet-absorbing agent can be present particularly together with a polymer having a high glass transition point (Tg).

As the polymer preferably used in the present invention, polymers described, for example, in JP-A No. 264748/1988 can be mentioned. Some preferable specified examples of the polymer are shown below, but the present invention is not restricted to them.

P-1) Poly(vinyl acetate)

P-2) Poly(methyl methacrylate)

P-3) Poly(ethyl methacrylate)

P-4) Poly(n-butyl methacrylate)
P-5) Poly(t-butyl methacrylate)
P-6) Poly(cyclohexyl methacrylate)
P-7) Poly(ethyl acrylate)
P-8) Poly(n-butyl acrylate)
P-9) Poly(t-butyl acrylate)
P-10) Poly(N-sec-butylacrylamide)
P-11) Poly(N-t-butylacrylamide)
P-12) Poly(N-t-butylmethacrylamide)
P-13) Poly(methyl vinyl ketone)
P-14) Polycaprolactone
P-15) Polypropionlactone
P-16) Polystyrene
P-17) Styrene/methyl methacrylate copolymer (10:90)
P-18) Styrene/methyl methacrylate copolymer (20:80)
P-19) Styrene/ethyl methacrylate copolymer (20:80)
P-20) Styrene/n-butyl methacrylate copolymer (20:80)

As the method for causing the ultraviolet-absorbing agent of the present invention to be present together with the polymer, for example, a method described in British Patent No. 2,016,017A and a method described in JP-A No. 264748/1988, wherein a hydrophobic linear polymer and an ultraviolet-absorbing agent are dissolved together in an organic solvent and the resulting mixed solution is emulsified and dispersed, can be mentioned, with the latter method being preferred. Specifically, the polymer of the present invention that is a so-called linear polymer, which is synthesized by solution polymerization, emulsion polymerization, or suspension polymerization, and which is not crosslinked, and the ultraviolet-absorbing agent of the present invention are dissolved completely in an organic co-solvent, and the solution is dispersed preferably in a hydrophilic colloid aqueous solution with the aid of a dispersant into a form of fine particles, for example, by using ultrasonic waves, a colloid mill, or a high-speed stirring machine. Alternatively, a hydrophilic colloid aqueous solution, such as an aqueous gelatin solution or water, may be added into an organic co-solvent containing a dispersing agent, such as a surface-active agent, the polymer of the present invention, and the ultraviolet-absorbing agent of the present invention, so that with phase reversal of emulsion they may form an oil-in-water dispersion. The organic co-solvent may be removed from the thus prepared dispersion, for example, by distillation, noodle washing, ultrafiltration, or vacuum deaeration. Herein the term "organic co-solvent" means an organic solvent useful in emulsification and dispersion that can be finally removed substantially from the photographic material in the drying step at the time of application or by the above technique or the like, and it is a low-boiling organic solvent or a solvent that is soluble in water to a certain extent, and it can be removed by washing with water or the like. The organic co-solvent includes an acetate of a lower alcohol, such as ethyl acetate and butyl acetate, ethyl propionate, secondary butyl alcohol, methyl ethyl ketone, methyl isobutyl ketone, β-ethoxyethyl acetate, methyl Cellosolveacetate, and cyclohexanone.

Further, if necessary, an organic solvent that can be completely miscible with water, such as methyl alcohol, ethyl alcohol, acetone, and tetrahydrofuran can be additionally used in part.

Two or more such organic solvents may be used in combination. Further, a high-boiling organic solvent can be additionally used.

The average particle diameter of the thus obtained lipophilic fine particles is preferably 0.02 to 2 μm, more preferably 0.02 to 0.4 μm. The particle diameter of the lipophilic fine particles can be measured by a measuring apparatus, such as Nanosizer made by Coulter Co. (England).

The lipophilic fine particles of the present invention may contain various lipophilic substances for photography. Examples of the lipophilic substances for photography include high-boiling organic solvents, non-dye-forming couplers, developing-agents, developing-agent precursors, development retarder precursors, development accelerators, gradation adjustors, such as a hydroquinones, dyes, dye-releasing agents, antioxidants, fluorescent brightening agents, and anti-fading additives, which may be used in combination.

To describe the epoxy compound represented by formula (III), (IV), or (V) in detail, $R^1$, $R^2$, and $R^3$ each represent a halogen atom or an alkyl group, which may be straight chain or branched chain, having carbon atom number of 1 to 4, preferably 1 to 2; and $L^1$ and $L^2$ each is preferably an alkylene group or a substituted alkylene group and examples of them have the following structures:

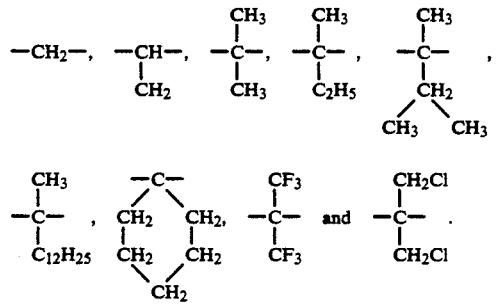

Preferably A is, for example, an alkylene group, a substituted alkylene group, an oxygen atom, a sulfur atom, a sulfonyl group, an oxycarbonyl group, an amido group, a phosphorus atom, a phosphoric acid group, a nitrogen atom, or a sulfonamido group, and in particular

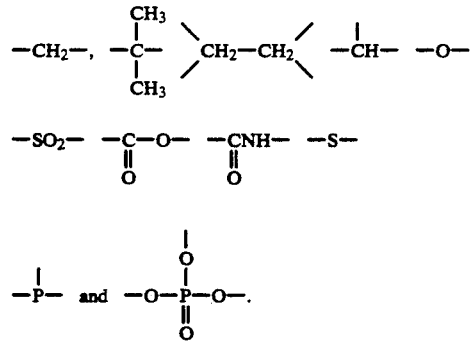

In this specification and claims, the term "sparingly water-soluble" means that the solubility in water at 25° C. is 10% or less. The epoxy compound of the present invention is used by emulsifying and dispersing together with or separately from the coupler into a hydrophilic binder, such as an aqueous gelatin solution using a surface-active agent. At that time, a sparingly water-soluble high-boiling organic solvent having a boiling point of 160° C. or over, or a low-boiling organic co-solvent can also be used. The coupler and the sparingly water-soluble epoxy compound can be added to separate layers but preferably they are added to the same in particular to the same oil droplets.
Specific examples of the compounds that can be used in the present invention and are represented by formulas (III), (IV), and (V) are shown below, but the present invention is not restricted to them.
(III-1)
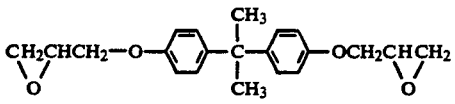
(III-2)
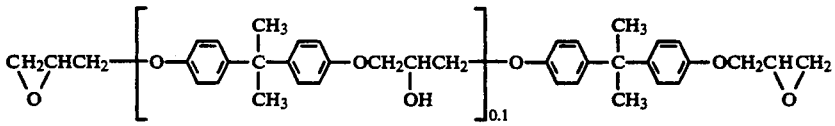
(III-3)
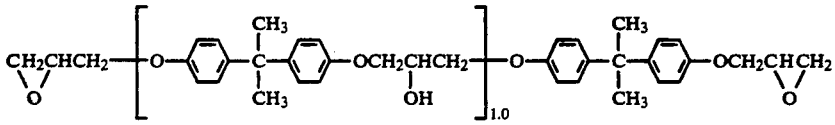
(III-4)
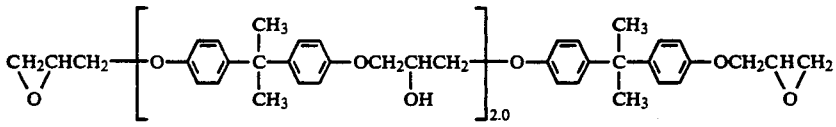
(III-5)
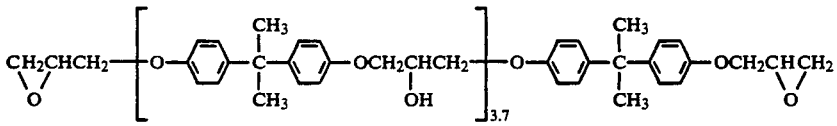
(III-6)
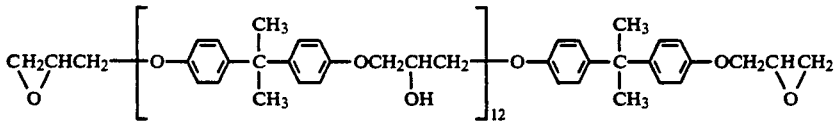
(III-7)
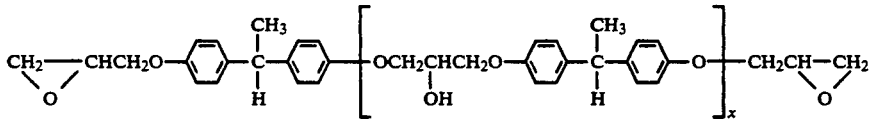
(III-8)
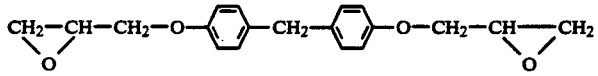
(III-9)
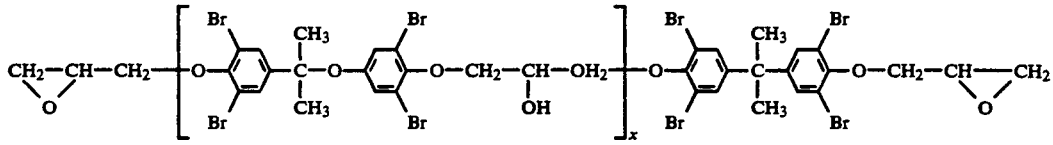
(III-10)
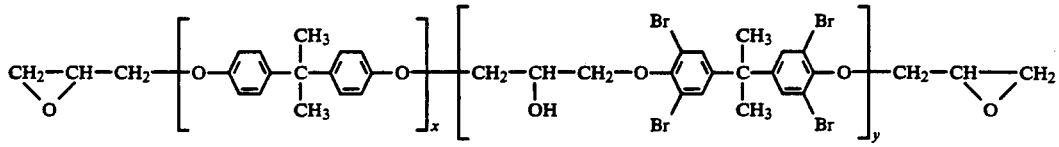

-continued
(III-11)
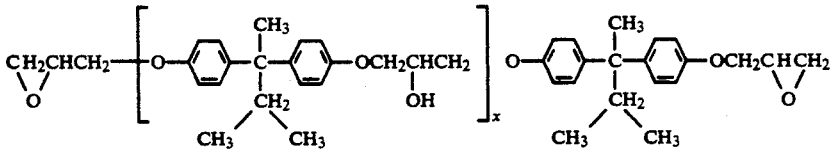
(III-12)
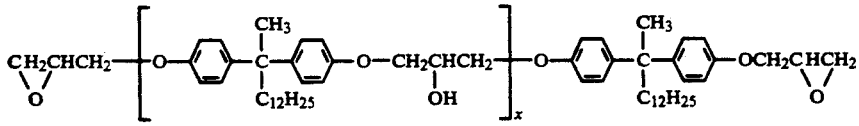
(III-13)
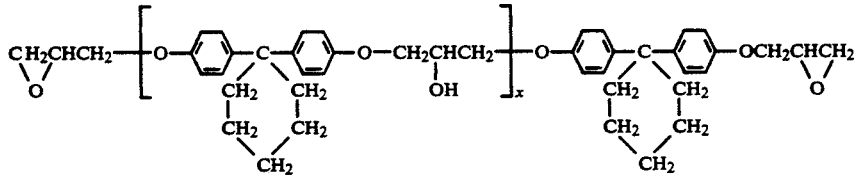
(III-14)
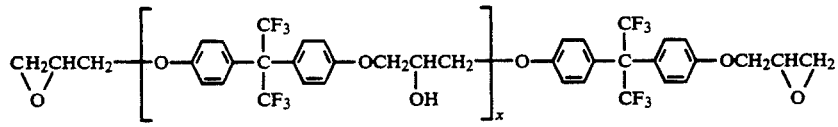
(IV-1)
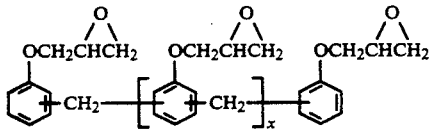
(IV-2)
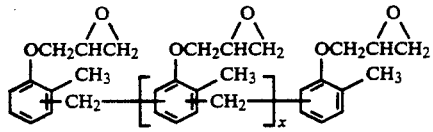
(IV-3)
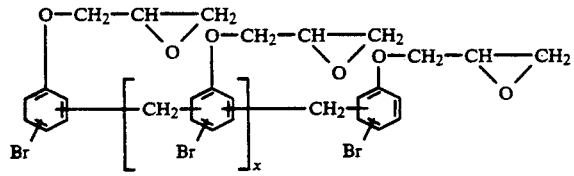
(V-1)
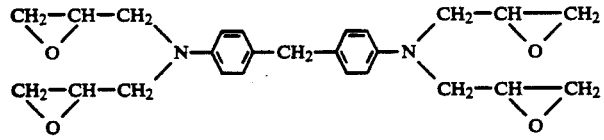
(V-2)
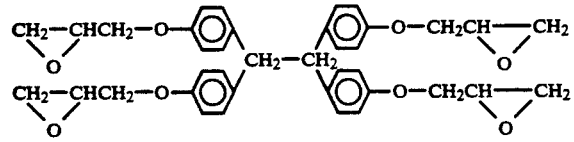
(V-3)
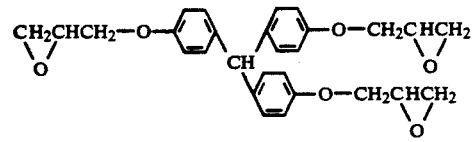

-continued

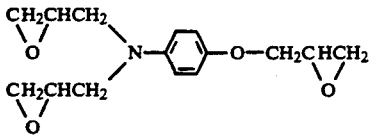

(V-4)

In the above structural formulae, the variable x is a real number and may be any real number in the range of 0 to 20. The reason why x is not necessarily an integer is that epoxy compounds having different integral values are mixed in a certain ratio and the variable x is the average value of the different integral values. These epoxy compounds may be used alone or as a mixture of two or more, or may be used in combination with a high-boiling organic solvent and/or a water-soluble and organic solvent-soluble polymer. Preferable examples of the high-boiling organic solvent and the polymer are those disclosed in JP-A No. 537/1989.

The above-mentioned epoxy resin used in the present invention is, for example, one obtained by reacting bisphenol A with epichlorohydrin in the presence of caustic soda (Naoshiro Ohishi, et al., *Prasuchikku Zairyo Koza* (5), *Epokishi Jushi* Nikkan Kogyo Shinbunsha). As this epoxy resin, a commercially available one can be used, for example, Epikote (manufactured by Shell Chemical Corp.), Araldite (manufactured by Ciba Ltd.), Bakelite (manufactured by UCC), DER (manufactured by Dow Chemical Co.), and EOCIV (manufactured by Nihon Kayaku Co.), which are trade names.

Compounds represented by formulae (III), (IV), and (V) are added preferably in an amount of 3 to 100%, more preferably 5 to 30%, in weight to the yellow coupler.

Specific examples of high-boiling coupler solvent are shown below, but the invention is not restricted to them.

$O{=}P(OC_4H_9\text{-}n)_3$ (S-1)

$O{=}P(OCH_2CH_2\underset{\underset{CH_3}{|}}{C}HCH_3)_3$ (S-2)

$O{=}P(OC_6H_{13}\text{-}\underline{n})_3$ (S-3)

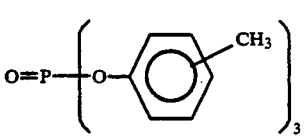

(S-4)

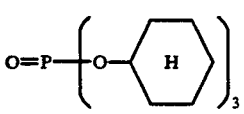

(S-5)

$O{=}P(OC_8H_{17}\text{-}\underline{n})_3$ (S-6)

$O{=}P\left(O\underset{\underset{CH_2CH_3}{|}}{C}HCH_2C_4H_9\text{-}\underline{n}\right)_3$ (S-7)

-continued

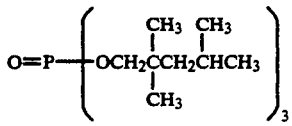

(S-8)

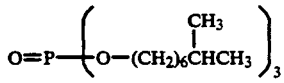

(S-9)

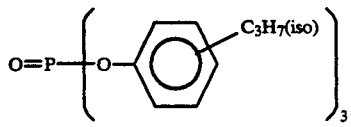

(S-10)

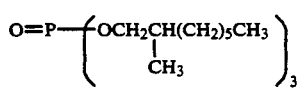

(S-11)

$O{=}P(OC_{10}H_{21}\text{-}\underline{n})_3$ (S-12)

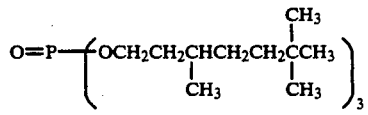

(S-13)

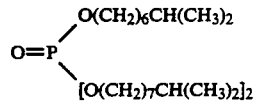

(S-14)

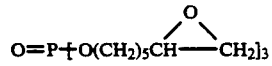

(S-20)

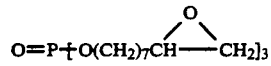

(S-21)

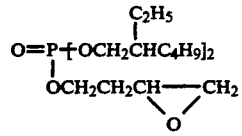

(S-22)

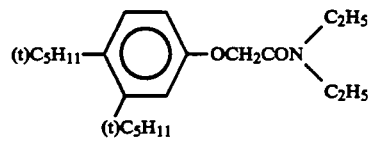

(S-23)

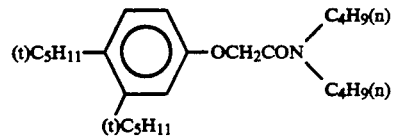

(S-24)

-continued
(S-25)
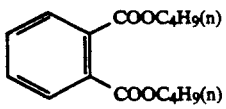
(S-26)
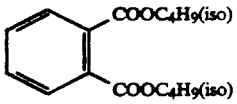
(S-27)
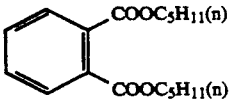
(S-28)
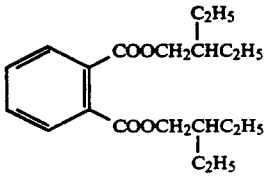
(S-29)
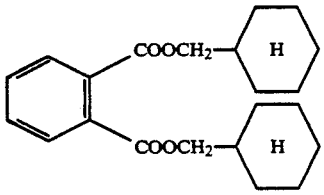
(S-30)
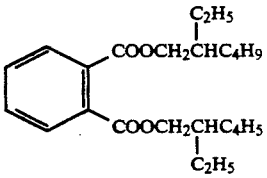
(S-31)
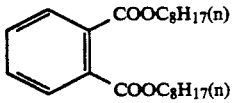
(S-32)
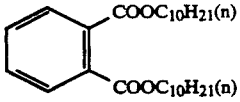
(S-33)
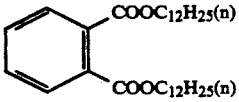
(S-34)
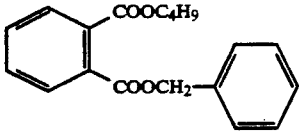
(S-35)
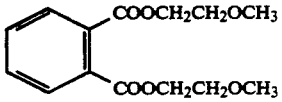
-continued
(S-36)
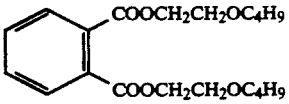
(S-37)
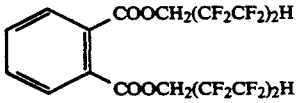
(S-38)
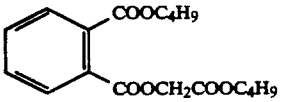
(S-39)
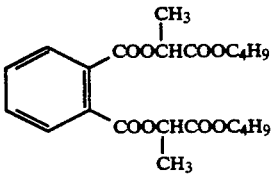
(S-40)
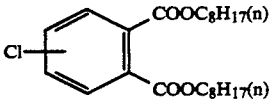
(S-41)
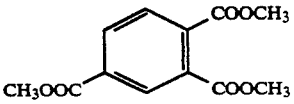
(S-42)
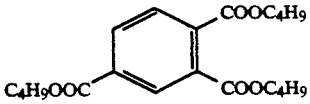
(S-43)
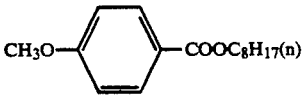
(S-44)
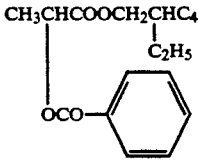
(S-45)
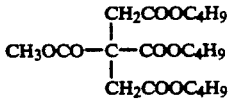
(S-46)
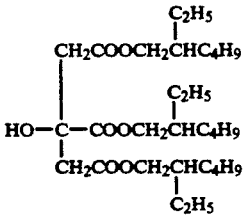
(S-47)
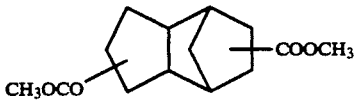

-continued

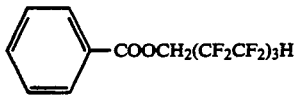

(S-48)

$CHCOOCH_2(CF_2CF_2)_2H$
$\|$
$CHCOOCH_2(CF_2CF_2)_2H$ (S-49)

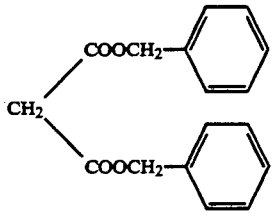

(S-50)

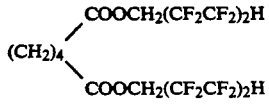

(S-51)

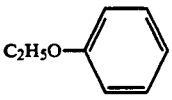

(S-52)

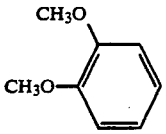

(S-53)

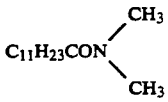

(S-54)

$C_{12}H_{25}OH$ (S-55)
$C_{16}H_{33}OH$ (S-56)
$C_{18}H_{37}OH$ (S-57)
$C_{10}H_{21}O(CH_2)_5O(CH_2)_2OH$ (S-58)

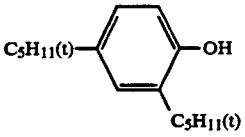

(S-59)

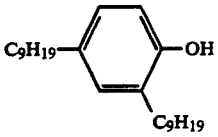

(S-60)

$CH_3(CH_2)_{17}Cl$ (S-61)
$CH_3(CH_2)_{15}Br$ (S-62)

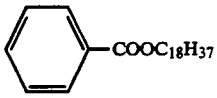

(S-63)

-continued

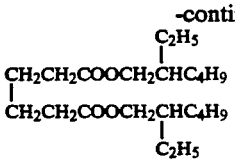

(S-64)

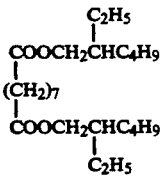

(S-65)

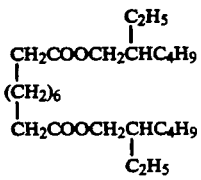

(S-66)

The color photographic material of the present invention can be constituted by applying at least each of a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive color process can be performed by incorporating, into these photosensitive emulsion layers, silver halide emulsions sensitive to respective wavelength ranges, and so-called colored-couplers capable of forming dyes complementary to light to which the couplers are respectively sensitive, that is, capable of forming yellow complementary to blue, magenta complementary to green, and cyan complementary to red. However, the constitution may be such that the photosensitive layers and the color formed from the couplers do not have the above relationship.

As the silver halide emulsion used in the present invention, one comprising silver chlorobromide or silver chloride and being substantially free from silver iodide can be preferably used. Herein the term "substantially free from silver iodide" means that the silver iodide content is 1 mol % or below, and preferably 0.2 mol % or below. Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

As to the silver halide composition of these silver chlorobromide emulsions, the ratio of silver bromide/silver chloride can be selected arbitrarily. That is, the ratio is selected from the broad range in accordance with the purpose, but the ratio of silver chloride in a silver chlorobromide is preferably 2% or over.

Further in the photographic material suitable for the rapid processing of an emulsion of high silver chloride content, so-called a high-silver-chloride emulsion may be used preferably. The content of silver chloride of the high-silver-chloride emulsion is preferably 90 mol % or over, more preferably 95 mol % or over.

In these high-silver-chloride emulsions, the structure is preferably such that the silver bromide localized phase in the layered form or nonlayered form is present in the silver halide grain and/or on the surface of the silver halide grain as mentioned above. The silver bromide content of the composition of the above-mentioned localized phase is preferably at least 10 mol %, and more preferably over 20 mol %. The localized phase may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol % or over, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol %, is also preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be preferably used.

The silver chlorobromide emulsion used in the present invention can be prepared by methods described, for example, by P. Glafkides, in *Chimie et Phisicue Photgraphique* (published by Paul Montel, 1967), by G. F. Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

Into the silver halide emulsion used in the present invention, various polyvalent metal ion dopants can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

As the chemical sensitization method, sulfur sensitization, wherein typically an unstable sulfur compound is added, noble metal sensitization, represented by gold sensitization, or reduction sensitization can be used alone or in combination. As the compounds used in the chemical sensitization, preferably those described in JP-A No. 215272/1987, page 18 (the right lower column) to page 22 (the right upper column), are used.

The spectral sensitization is carried out for the purpose of providing the emulsions of the layers of the photographic material of the present invention with spectral sensitivities in desired wavelength regions. In the present invention, the spectral sensitization is preferably carried out by adding dyes that absorb light in the wavelength ranges corresponding to the desired spectral sensitivities, that is, by adding spectrally sensitizing dyes. As the spectrally sensitizing dyes used herein, for example, those described by F. M. Harmer in *Heterocyclic Compounds-Cyanine Dyes and Related Compounds* (published by John Wiley & Sons [New York, London], 1964) can be mentioned. As specific examples of the compounds and the spectral sensitization method, those described in the above JP-A No. 215272/1987, page 22 (the right upper column) to page 38, are preferably used.

In the silver halide emulsion used in the present invention, various compounds or their precursors can be added for the purpose of stabilizing the photographic performance or preventing fogging that will take place during the process of the production of the photographic material, or during the storage or photographic processing of the photographic material. As specific examples of these compounds, those described in the above-mentioned JP-A No. 215272/1987, pages 39 to 72, are preferably used.

As the emulsion used in the present invention, use is made of a so-called surface-latent image-type emulsion, wherein a latent image is formed mainly on the grain surface, or of a so-called internal-latent image-type emulsion, wherein a latent image is formed mainly within the grains.

When the present invention is used for color photographic materials, generally in the color photographic material are used a yellow coupler, a magenta coupler, and a cyan coupler, which will couple with the oxidized product of the aromatic amine color-developing agent to form yellow, magenta, and cyan.

Cyan couplers and yellow couplers preferably used in combination with the coupler of the present invention are those represented by the following formulae (C-I), (C-II), and (Y):

Formula (C-I)

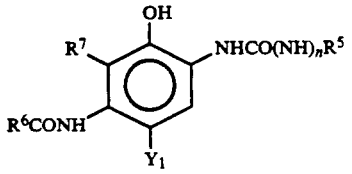

Formula (C-II)

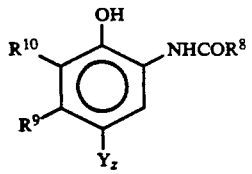

Formula (Y)

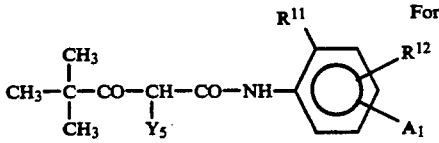

In formulae (C-I) and (C-II), $R^5$, $R^6$, and $R^8$ each represent a substituted or unsubstituted aliphatic, aromatic, or heterocyclic group, $R^7$, $R^9$, and $R^{10}$ each represent a hydrogen atom, a halogen atom, an aliphatic group, an aromatic group, or an acylamino group, $R^7$ and $R^6$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R^9$ preferably represents an aliphatic group such as a methyl group, an ethyl group, a propyl group, a butyl group, a pentadecyl group, a tertbutyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below.

In formula (C-I), preferable $R^5$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R^7$ and $R^6$ together do not form a ring, $R^6$ is preferably a substituted or unsubstituted alkyl group, or aryl group, and particularly preferably an alkyl group substituted by a substituted aryloxy, and preferably $R^7$ represents a hydrogen atom.

In formula (C-II), preferable $R^8$ is a substituted or unsubstituted alkyl group or aryl group, and particularly preferably an alkyl group substituted by a substituted aryloxy group.

In formula (C-II), preferable $R^9$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R^9$ is an alkyl group having 2 to 15 carbon atoms, and particularly preferably an alkyl group having 2 to 4 carbon atoms.

In formula (C-II), preferable $R^{10}$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (Y), $R^{11}$ represents a halogen atom, an alkoxy group, a trifluoromethyl group, or an aryl group, and $R^{12}$ represents a hydrogen atom, a halogen atom, or an alkoxy group. $A_1$ represents $—NHCOR^{13}$, $—NHSO_2—R^{13}$, $—SO_2NHR^{13}$, $—CCOR^{13}$, or $$—SO_2\underset{\underset{R^{14}}{|}}{N}—R^{13},$$

wherein $R^{13}$ and $R^{14}$ each represent an alkyl group, an aryl group, or an acyl group. $Y_5$ represents a coupling split-off group. Substituents of $R^{12}$, $R^{13}$, and $R^{14}$ are the same as those acceptable to $R^5$, and the coupling split-off group $Y_5$ is of the type that will split off preferably at an oxygen atom or a nitrogen atom, and particularly preferably it is of the nitrogen atom split-off type.

Specific examples of couplers represented by formulae (C-I), (C-II), and (Y) are listed below.

(C-1)
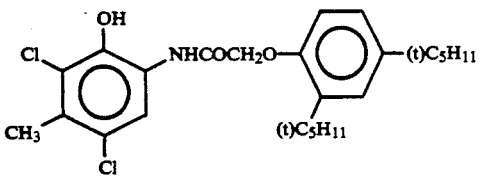
(C-2)
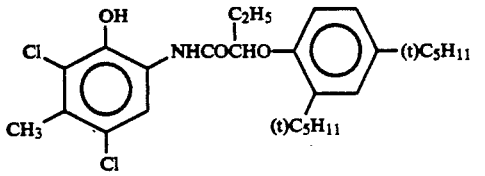
(C-3)
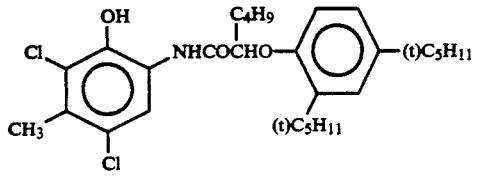
(C-4)
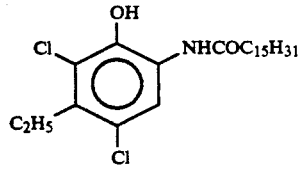
(C-5)
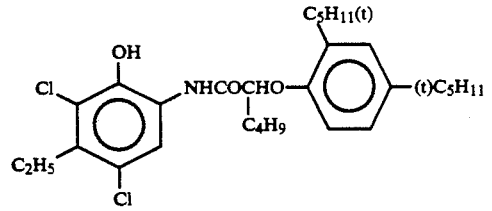
(C-6)
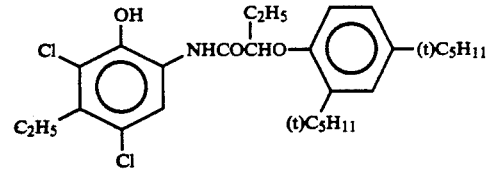
(C-7)
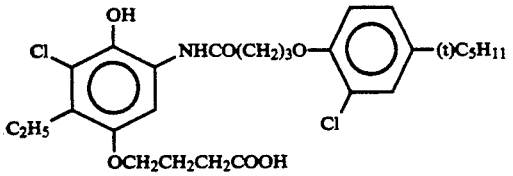
(C-8)
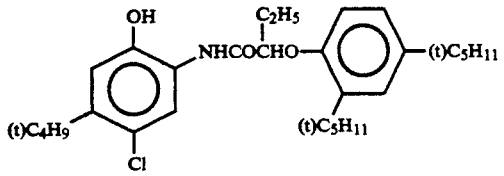

-continued
(C-9)
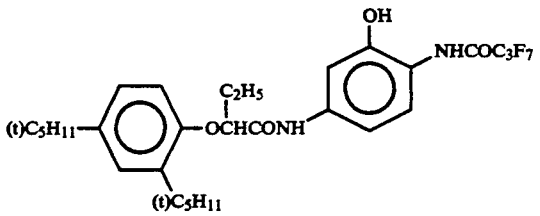
(C-10)
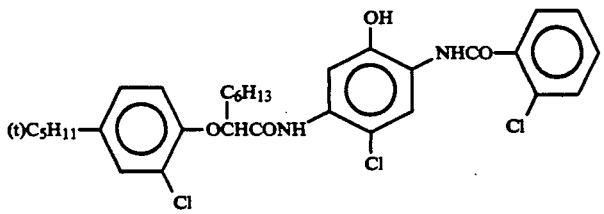
(C-11)
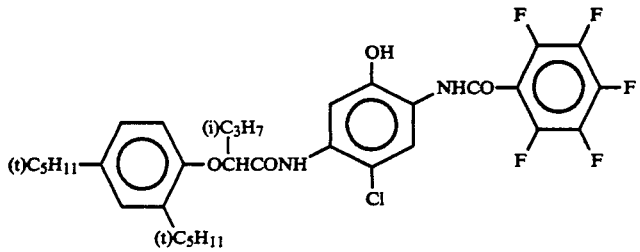
(C-12)
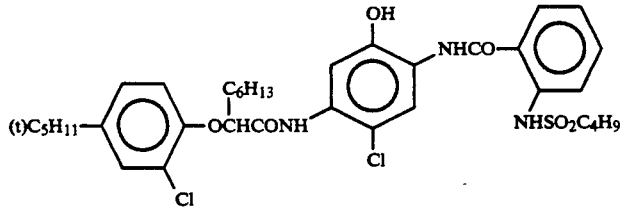
(C-13)
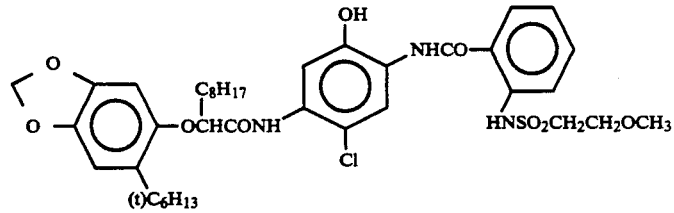
(C-14)
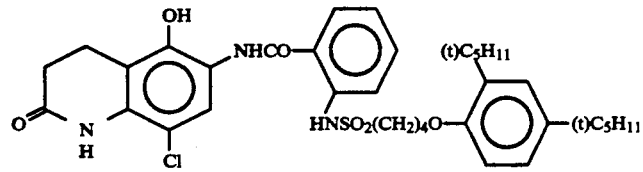
(C-15)
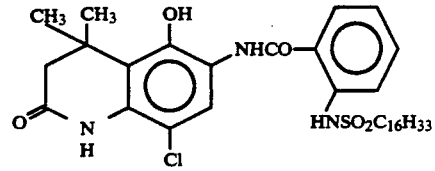

-continued
(C-16)
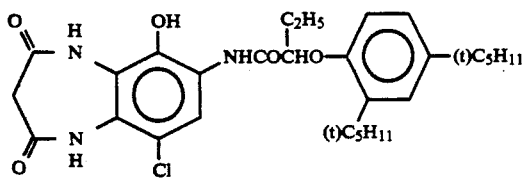
(C-17)
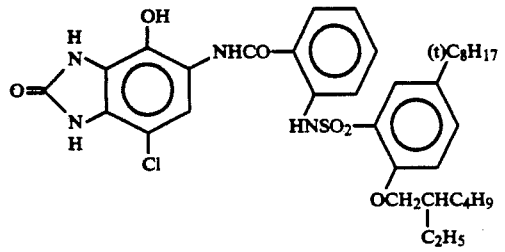
(C-18)
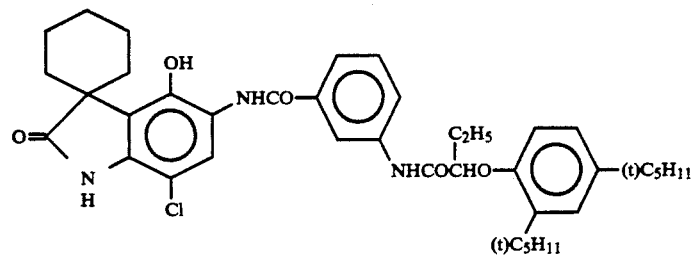
(C-19)
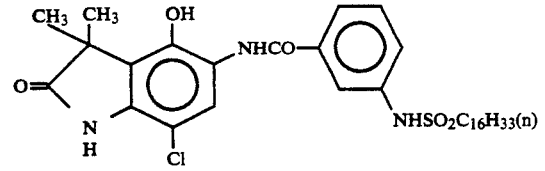
(C-20)
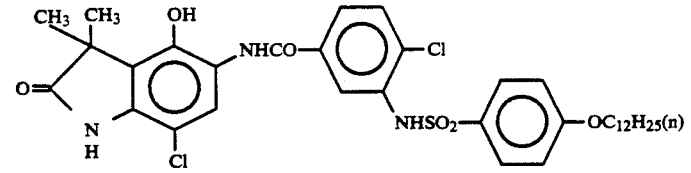
(C-21)
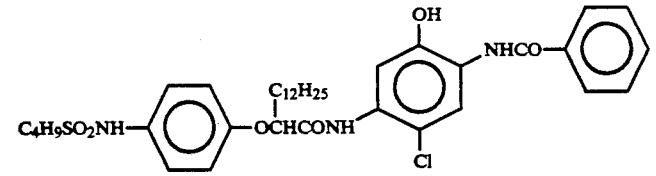
(C-22)
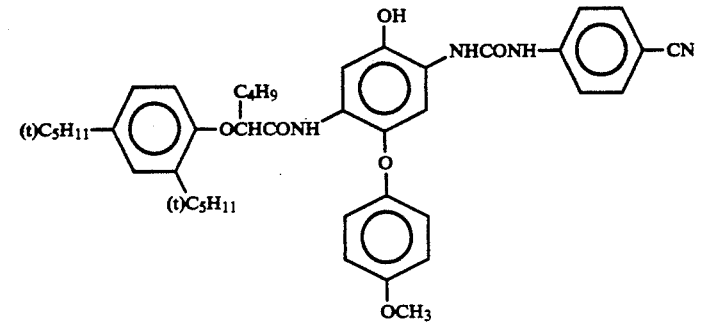

-continued
(Y-1)
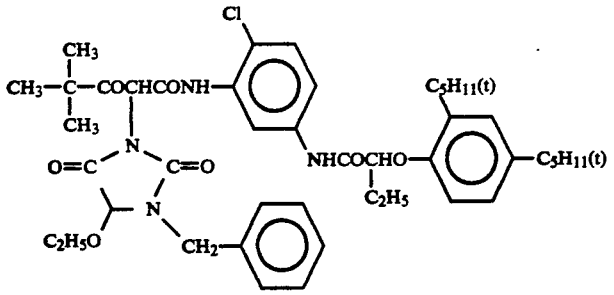
(Y-2)
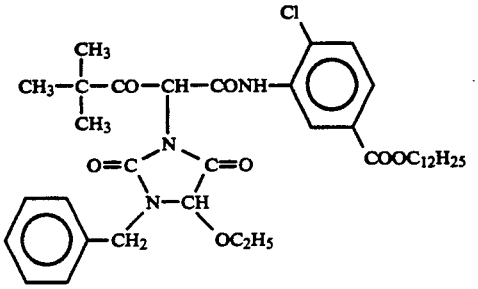
(Y-3)
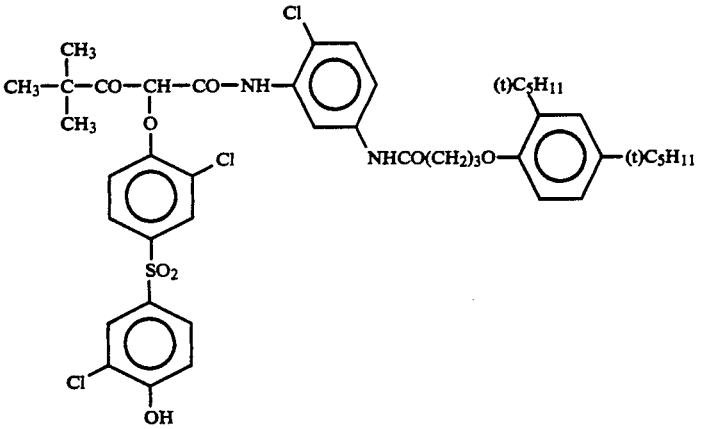
(Y-4)
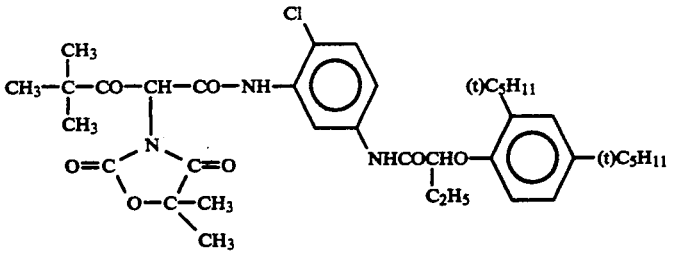
(Y-5)
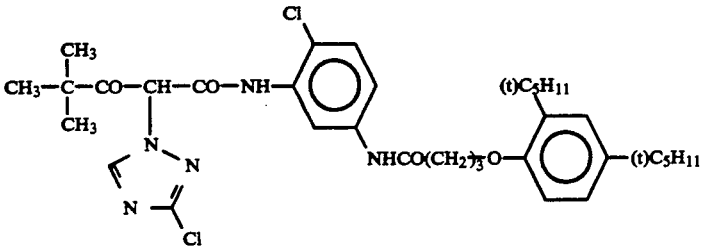

-continued
(Y-6)
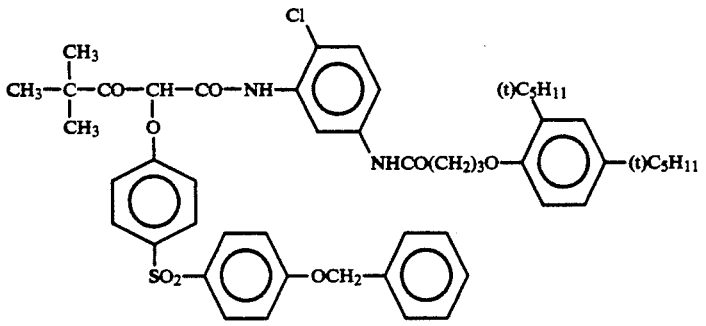
(Y-7)
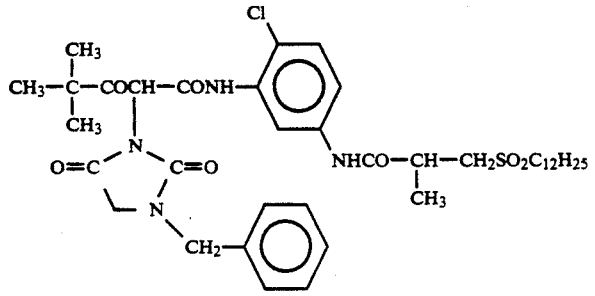
(Y-8)
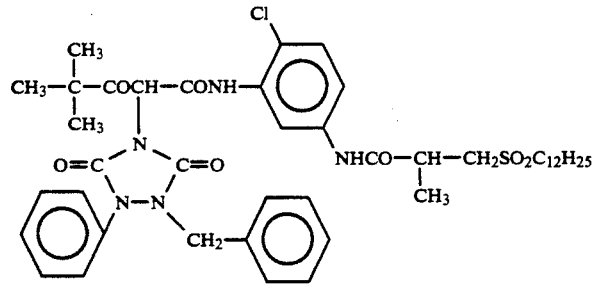
(Y-9)
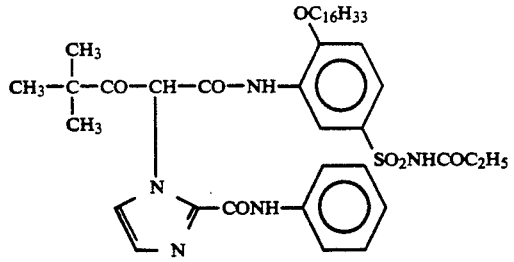
(Y-10)
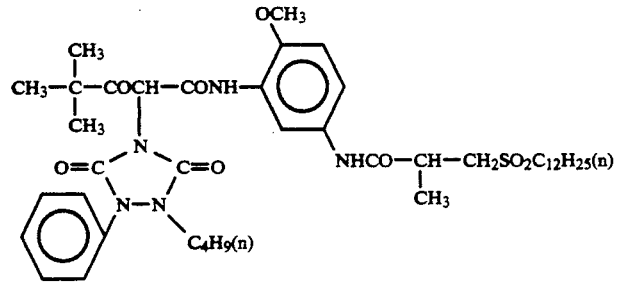

-continued (Y-11)

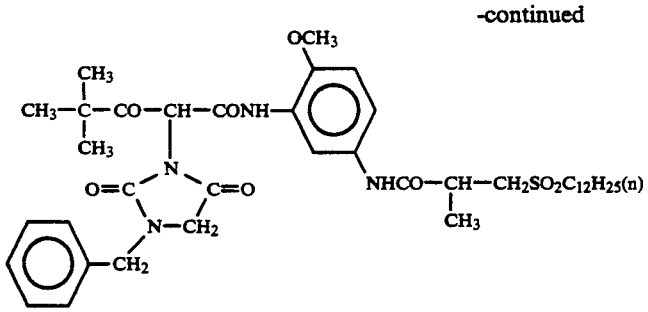

(Y-12)

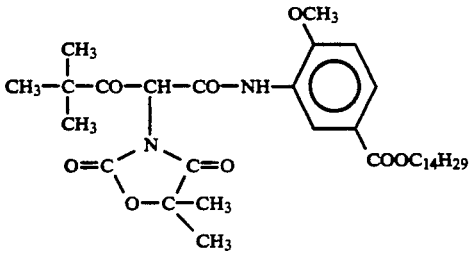

(Y-13)

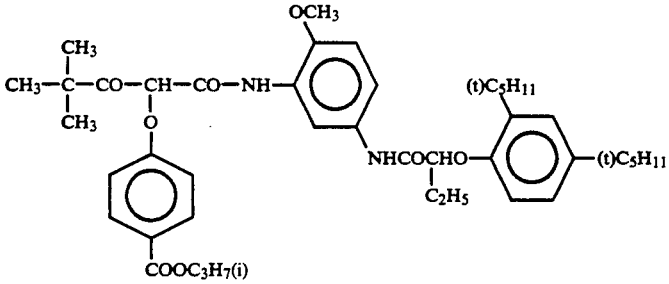

(Y-14)

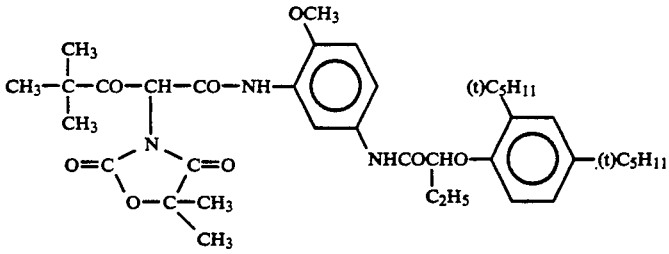

The couplers represented by formulae (C-I) to (Y) are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent for the coupler of the present invention and other couplers, a high-boiling organic solvent represented by the following formula (A), (B), (C), (D), or (E) is preferably used.

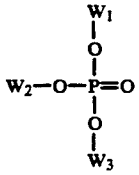

Formula (A)

$W_1-COOW_2$ Formula (B)

-continued

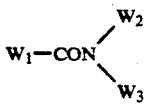

Formula (C)

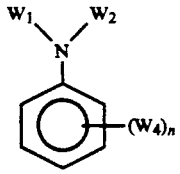

Formula (D)

$W_1—O—W_2$ Formula (E)

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or $S-W_1$, n is an integer of 1 to 5, when n is 2 or over, $W_4$ groups may be the same or different, and in formula (E), $W_1$ and $W_2$ may together form a condensed ring.

As the high-boiling organic solvent used in the present invention, any compound other than compounds represented by formulae (A) to (E) can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato) nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Pat. No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Pat. No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Pat. Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Pat. 2,027,731(A). To attain the purpose, these compounds can be added to the photosensitive layers by coemulsifying them with the corresponding couplers, with the amount of each compound being generally 5 to 100 wt. % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine at a the second-order reaction rate $k_2$ (in trioctyl phosphate at 80° C.) in the range of 1.0 l/mol·sec to $1\times10^{-5}$ l/mol·sec. The second-order reaction rate can be determined by the method described in JP-A No. 158545/1983.

If $k_2$ is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

Formula (FI)

$$R_{21}-(A)_n-X \qquad \text{Formula (FI)}$$

$$R_{22}-\underset{\underset{B}{|}}{C}=Y \qquad \text{Formula (FII)}$$

wherein $R_{21}$ and $R_{22}$ each represent an aliphatic group, an aromatic group, or a heterocyclic group, n is 1 or 0, A represents a group that will react with an aromatic amine developing agent to form a chemical bond therewith, X represents a group that will react with the aromatic amine developing agent and split off, B represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R_{21}$ and X, or Y and $R_{22}$ or B, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R\text{-}Z \qquad \text{Formula (GI)}$$

wherein R represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^{n}CH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Pat. No. 255722, JP-A Nos. 143048/1987, 229145/1987, 230039/1989, and 57259/1989, and European Published Pat. Nos. 298321 and 277589.

Details of combinations of compound (G) and compound (F) are described in European Published Pat. No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-processed gelatin or acid-processed gelatin. Details of the manufacture of gelatin is described by Arthur Veis in *The Macromolecular Chemistry of* Gelatin (published by Academic Press, 1964).

As a base to be used in the present invention, a transparent film, such as cellulose nitrate film, and polyethylene terephthalate film or a reflection-type base that is generally used in photographic materials can be used. The use of a reflection-type base is more preferable.

The "reflection base" is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided with an antistatic layer. The details of such base are described, for example, in JP-A Nos. 210346/1986, 24247/1988, 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 μm×6 μm, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n}(R_i-\overline{R})^2}{n-1}} \Big/ \frac{\sum_{i=1}^{n}R_i}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

Preferably, the color developer used for the development processing of the photographic material of the present invention is an aqueous alkaline solution whose major component is an aromatic primary amine derivative. As the aromatic primary amine derivative aminophenol compounds are useful, though p-phenylene diamine compounds are preferably used, and typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 4-amino-N-ethyl-N-β-hydroxyethylaniline, and 3-methyl-4-amino-N-ethyl-N-β-methoxyethylaniline, and their sulfates, hydrochlorides, and p-toluenesulfonates. A combination of two or more of these compounds may be used in accordance with the purpose.

The color developer generally contains, for example, buffers, such as carbonates or phosphates of alkali metals, and development inhibitors or antifoggants, such as bromide salts, iodide salts, benzimidazoles, benzothiazoles, or mercapto compounds. The color developer may, if necessary, contain various preservatives, such as hydroxylamine, diethylhydroxylamine, sulfites, hydrazines for example N,N-biscarboxymethylhydrazine, phenylsemicarbazides, triethanolamine, and catecholsulfonic acids, organic solvents such as ethylene glycol and diethylene glycol, development accelerators such as benzyl alcohol, polyethylene glycol, quaternary ammonium salts, and amines, dye forming couplers, competing couplers, auxiliary developers such as 1-phenyl-3-pyrazolidone, tackifiers, and various chelate agents as represented by aminopolycarboxylic acids, aminopolyphosphonic acids, alkylphosphonic acids, and phosphonocarboxylic acids, typical example thereof being ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and their salts.

If reversal processing is carried out, it is common that after black and white development and reversal processing are carried out, the color development is carried out. As the black and white developers, known black and white developing agents, such as dihydroxybenzenes, for example hydroquinone, 3-pyrazolidones, for example 1-phenyl-3-pyrazolidone, and aminophenols, for example N-methyl-p-aminophenol, can be used alone or in combination.

Generally the pH of this color developer and black-and-white developing solution is 9 to 12. The replenishing amount of these developing solutions is generally 3 liters or below per square meter of the color photographic material to be processed, though the replenishing amount changes depending on the type of color photographic material, and if the concentration of bromide ions in the replenishing solution is lowered previously, the replenishing amount can be lowered to 500 ml or below per square meter of the color photographic material. If it is intended to lower the replenishing amount, it is preferable to prevent the evaporation of the solution and oxidation of the solution with air by reducing the area of the solution in processing tank that is in contact with the air. The contact area of the photographic processing solution with the air in the processing tank is represented by the open surface ratio which is defined as follows:

$$\text{Open surface ratio } (\text{cm}^{-1}) = \frac{\text{Contact surface area } (\text{cm}^2) \text{ of the processing solution with the air}}{\text{Whole volume } (\text{cm}^3) \text{ of the processing solution}}$$

wherein "contact surface area of the processing solution with the air" means a surface area of the processing solution that is not covered by anything such as floating lids or rolls.

The opened surface ratio is preferably 0.1 $cm^{-1}$ or less, more preferably 0.001 to 0.05$cm^{-1}$.

Methods for reducing the opened surface ratio that can be mentioned include a utilization of movable lids as described in JP-A NO. 241342/1987 and a slit-developing process as described in JP-A No. 216050/1988, besides a method of providing a shutting materials such as floating lids.

It is preferable to adopt the means for reducing the open surface ratio not only in a color developing and black-and-white developing process but also in all succeeding processes, such as bleaching, bleach-fixing, fixing, washing, and stabilizing process.

It is also possible to reduce the replenishing amount by using means of suppressing the accumulation of bromide ions in the developer.

Although the processing time of color developing is settled, in generally, between 2 and 5 minutes, the time can be shortened by, for example, processing at high temperature and at high pH, and using a color developer having high concentration of color developing agent.

The photographic emulsion layer are generally subjected to a bleaching process after color development.

The beaching process can be carried out together with the fixing process (bleach-fixing process), or it can be carried out separately from the fixing process. Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process. As the bleaching agent, use can be made of, for example, compounds of polyvalent metals, such as iron (III). As typical bleaching agent, use can be made of organic complex salts of iron (III), such as complex salts of aminopolycarboxylic acids, for example ethylenediaminetetraacetic acid, diethylenetriaminetetraacetic acid, cyclohexanediaminetetraacetic acid, methyliminodiacetic acid, 1,3-diaminopropanetetraacetic acid, and glycoletherdiaminetetraacetic acid, citric acid, tartaric acid, and malic acid. Of these, aminopolycarboxylic acid iron (III) complex salts, including ethylenediaminetetraacetic acid iron (III) complex salts are preferable in view of rapid-processing and the prevention of pollution problem. Further, aminopolycarboxylic acid iron (III) complex salts are particularly useful in a bleaching solution as well as a bleach-fixing solution. The pH of the bleaching solution or the bleach-fixing solution using these aminopolycarboxylic acid iron (III) complex salts is generally 4.0 to 8.0, by if it is required to quicken the process, the process can be effected at a low pH.

In the bleaching solution, the bleach-fixing solution, and the bath preceding them a bleach-accelerating agent may be used if necessary. Examples of useful bleach-accelerating agents are compounds having a mercapto group or a disulfide linkage, described in U.S. Pat. No. 95630/1978, and Research Disclosure No. 17129 (July, 1978); thiazolidine derivatives, described in JP-A No. 140129/1975; thiourea derivatives, described in U.S. Pat. No. 3,706,561; iodide salts, described in JP-A No. 16235/1983; polyoxyethylene compounds in West German Pat. No. 2,748,460; polyamine compounds, described in JP-B No. 8836/1970; and bromide ions. Of these, compounds having a mercapto group or a disulfide group are preferable in view of higher acceleration effect, and in particular, compounds described in U.S. Pat. No. 3,893,858, West German Pat. No. 1,290,812, and JP-A No. 95630/1978 are preferable. Compound described in U.S. Pat. No. 4,552,834 are preferable. These bleach-accelerating agents may be added into a photographic material. When the color photographic materials for photographing are to be bleach-fixed, these bleach-accelerating agents are particularly effective.

As a fixing agent can be mentioned thiosulfates, thiocyanates, thioether-type compounds, thioureas, and large amounts of iodide salts, although thiosulfate is used usually, and in particular ammonium thiosulfate is widely used. As the preservative for bleach-fix solution sulfite salt, bisulfite salt, or carbonyl-bisulfite adduct is preferably.

It is common for the silver halide color photographic material of the present invention to undergo, after a desilvering process such as fixing or bleach-fix, a washing step and/or a stabilizing step. The amount of washing water may be set within a wide range depending on the characteristics (e.g., due to the materials used, such as couplers), the application of the photographic material, the washing temperature, the number of washing tanks (the number if steps), the type of replenishing system, including, for example, the counter-current system and the direct flow system and other various conditions. Of these, the relationship between the number of water-washing tanks and the amount of washing water in the multi-stage counter current system can be found according to the method described in *Journal of Society of Motion Picture and Television Engineers*, Vol. 64, pages 248 to 253 (May 1955).

According to the multi-stage-counter-current system described in the literature mentioned above, although the amount of washing water can be considerably reduced, bacteria propagate with an increase of retention time of the washing water in the tanks, leading to a photographic material. In processing the present color photographic material, as a measure to solve this problem the method of reducing calcium and magnesium described in JP-A No. 288838/1987 can be used quite effectively. Also chlorine-type bactericides such as sodium chlorinated isocyanurate, cyabendazoles, isothiazolone compounds described in JP-A No. 8542/1982, benzotriazoles, and other bactericides described by Hiroshi Horiguchi in *Bokin Bobai-zai no Kaqaku*, (1986) published by Sankyo-Shuppan, *Biseibutsu no mekkin, Sakkin, Bobaigijutsu* (1982) edited by Eiseigijutsu-kai, published by Kogyo-Gijutsu-kai, and in *Bokin Bobaizai Jiten* (1986) edited by Nihon Bokin Bobai-gakkai, can be used.

The pH of the washing water used in processing the present photographic material is 4 to 9, preferably 5 to 8. The washing water temperature and the washing time to be set may very depending, for example, on the characteristics and the application of the photographic material, and they are generally selected in the range of 15° to 45° C. for sec to 10 min, and preferably in the range of 25° to 40° C. for 30 sec to 5 min. Further, the photographic material of the present invention can be processed directly with a stabilizing solution instead of the above washing. In such a stabilizing process, any of known processes, for example, a multi-step counter-current stabilizing process or its low-replenishing-amount process, described in JP-A Nos. 8543/1982, 14834/1983, and 220345/1985.

In some cases, the above washing process is further followed by stabilizing process, and as an example thereof can be mentioned a stabilizing bath that is used as a final bath for color photographic materials for photography, which contains formalin and a surface-active agent. In this stabilizing bath, each kind of the chelating agents and bactericides may be added.

The over-flowed solution due to the replenishing of washing solution and/or stabilizing solution may be reused in other steps, such as a desilvering step.

The silver halide color photographic material of the present invention may contain therein a color-developing agent for the purpose of simplifying and quickening the process. To contain such a color-developing agent, it is preferable to use a precursor for color-developing agent. For example, indoaniline-type compounds described in U.S. Pat. No. 3,342,597, Schiff base-type compounds described in U.S. Pat. No. 3,342,599 and Research Disclosure Nos. 14850 and 15159, aldol compounds described in Research Disclosure No. 13924, and metal salt complexes described in U.S. Pat. No. 3,719,492, and urethane-type compounds described in JP-A No. 135628/1978 can be mentioned.

For the purpose of accelerating the color development, the present silver halide color photographic material may contain, if necessary, various 1-phenyl-3-pyrazolicones. Typical compounds are described in JP-A Nos. 64339/1981, 144547/1982, and 115438/1983.

The various processing solutions used for the present invention may be used at 10° to 50° C. Although generally a temperature of 33° to 38° C. may be standard, a higher temperature can be used to accelerate the process to reduce the processing time, or a lower temperature can be used to improve the image quality or the stability of the processing solution. Also, to save the silver of the photographic material, a process using hydrogen peroxide intensification or cobalt intensification described in West German Pat. No. 2,226,770 and U.S. Pat. No. 3,674,499 may be carried out.

By applying a combination of the method of the use of the coupler and the high-boiling solvent of the present invention with the method of the use of the ultraviolet ray absorbing agent of the present invention, the fastnesses of the yellow, magenta, and cyan of the image to sunlight as well as fluorescent lamp light are well balanced and are improved remarkably. Therefore it can be understood that the fastness of the image to sunlight; that is, the fastness of the image that is placed in an outdoor show window under sunlight, and the fading against an indoor fluorescent lamp both are improved remarkably, and the three colors; that is, yellow, magenta, and cyan, are improved in well balanced manner, so that a color photographic material that can be appreciated for a long period of time can be secured.

Next, the present invention will be described in detail in accordance with examples, but the invention is not limited to them.

EXAMPLE 1

A comparative sample (1) of multilayer photographic material having layer compositions shown below was prepared by coating various photographic constituting layers on a paper base laminated on both sides thereof with polyethylene film, followed by subjecting to a corona discharge treatment on the surface thereof, and provided a gelatin prime coat layer containing sodium-dodecylbenzenesulfonate. Coating solutions were prepared as follows:

PREPARATION OF THE FIRST LAYER COATING SOLUTION

To a mixture of 19.1 g of yellow coupler (ExY), 2.0 g of image-dye stabilizer (Cpd-1), 2.0 g of image-dye stabilizer (Cpd-7), 4.1 g of image-dye stabilizer (Cpd-12), and 0.1 g of image-dye stabilizer (Cpd-13), 27.2 ml of ethyl acetate and each 4.1 g of solvents (Solv-3) and (Solv-2) were added and dissolved. The resulting solution was dispersed and emulsified in 185 ml of 10% aqueous gelatin solution containing 8 ml of sodium dodecylbenzenesulfonate, thereby prepared emulsified dispersion A. Separately silver chlorobromide emulsion A (cubic grains, 3:7 (silver mol ratio) blend of grains having 0.88 μm and 0.70 μm of average grain size, and 0.08 and 0.10 of deviation coefficient of grain size distribution, respectively, each in which 0.3 mol % of silver bromide was located at the surface of grains) was prepared. Blue-sensitive sensitizing dyes A and B, shown below, were added in this emulsion A in such amounts that each dye corresponded to $2.0\times10^{-4}$ mol to the large size emulsion A and $2.5\times10^{-4}$ mol to the small size emulsion A, per mol of silver, respectively. The chemical ripening was carried out by adding sulfur and gold sensitizing agents. The above-described emulsified dispersion A and this emulsion A were mixed together and dissolved to give the composition shown below, thereby preparing the first layer coating solution.

Coating solutions for the second to seventh layers were also prepared in the same manner as the first layer coating solution. As a gelatin hardener for the respective layers, 1-hydroxy-3,5-dichloro-s-triazine sodium salt was used.

Further, Cpd-10 and Cpd-11 were added in each layer in such amounts that the respective total amount becomes 25.0 mg/m² and 50 mg/m².

As spectral-sensitizing dyes for the respective layers, the following compounds were used:

Sensitizing dye A for blue-sensitive emulsion layer

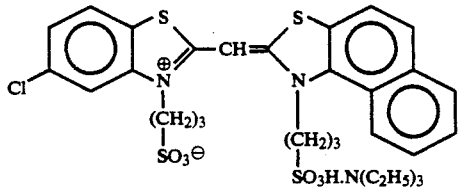

Sensitizing dye B for blue-sensitive emulsion layer

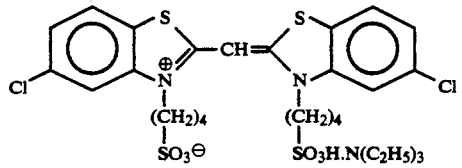

each $2.0\times10^{-4}$ mol to the large size emulsion A and $2.5\times10^{-4}$ mol to the small size emulsion B, per mol of silver halide.)

Sensitizing dye C for green-sensitive emulsion layer

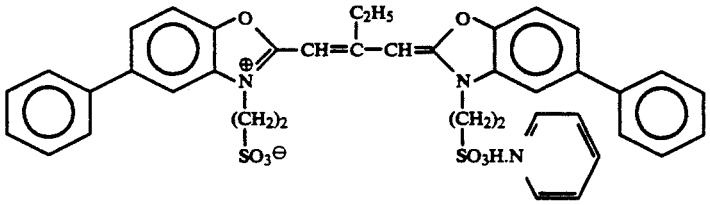

($4.0\times10^{-4}$ mol to the large size emulsion B and $5.6\times10^{-4}$ mol to the small size emulsion B, per mol of silver halide) and Sensitizing dye D for green-sensitive emulsion layer

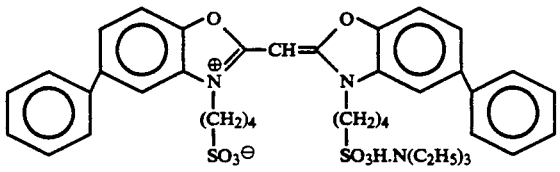

($7.0\times10^{-5}$ mol to the large size emulsion B and $1.0\times10^{-5}$ mol to the small size emulsion B, per mol of silver halide)

Sensitizing dye E for red-sensitive emulsion layer

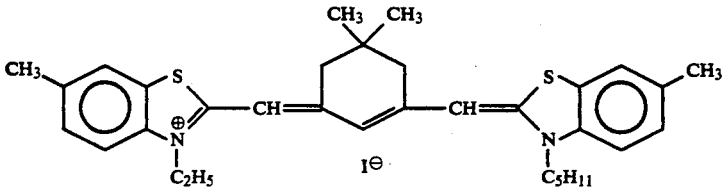

($0.9\times10^{-4}$ mol to the large size emulsion C and $1.1\times10^{-4}$ mol to the small size emulsion C, per mol of silver halide)

To the red-sensitive emulsion layer, the following compound was added in an amount of $2.6\times10^{-3}$ mol per mol of silver halide:

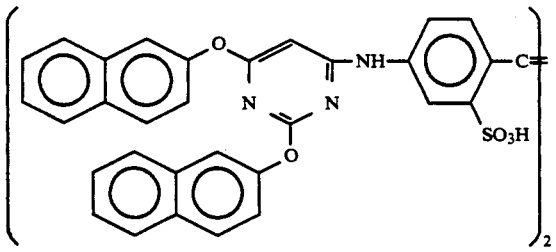

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.7\times10^{-4}$ mol, and $2.5\times10^{-4}$ mol, per mol of silver halide, respectively.

Further, 4-hydroxy-6-methyl-1,3,3*a*,7-tetrazaindene was added to the blue-sensitive emulsion layer and the green-sensitive emulsion layer in amount of $1\times10^{-4}$ mol and $2\times10^{-4}$ mol, per mol of silver halide, respectively. The dyes shown below (figure in parentheses represents coating amount) were added to the emulsion layers for prevention of irradiation.

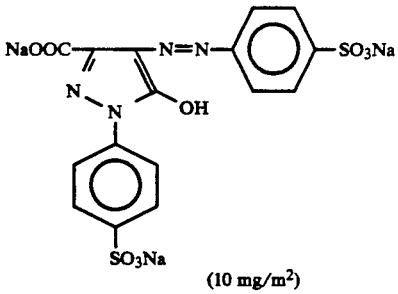

(10 mg/m²)

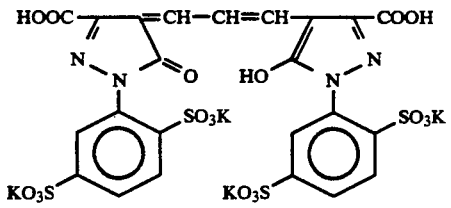

(10 mg/m²)

-continued

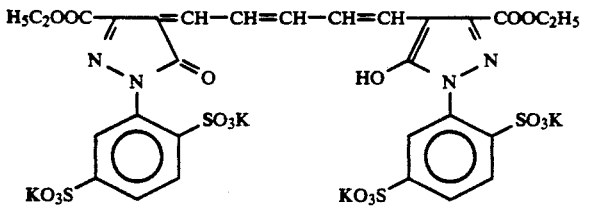

(40 mg/m²)

and

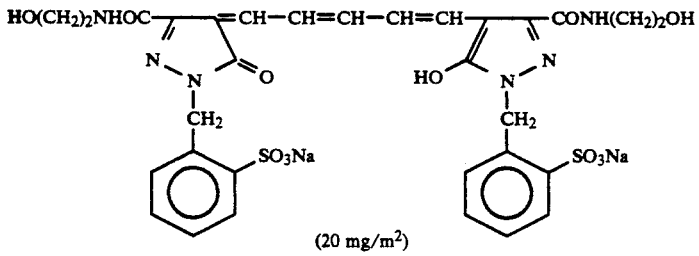

(20 mg/m²)

COMPOSITION OF LAYERS

The composition of each layer is shown below. The figures represent coating amount (g/m²). The coating amount of each silver halide emulsion is given in terms of silver.

SUPPORTING BASE

Paper laminated on both sides with polyethylene (a white pigment, $TiO_2$, and a bluish dye, ultra-marine, were included in the first layer side of the polyethylene-laminated film)

| | |
|---|---|
| First Layer (Blue-sensitive emulsion layer) | |
| The above-described silver chlorobromide emulsion A | 0.29 |
| Gelatin | 1.32 |
| Yellow coupler (E × Y) | 0.76 |
| Image-dye stabilizer (Cpd-1) | 0.08 |
| Image-dye stabilizer (Cpd-7) | 0.08 |
| Image-dye stabilizer (Cpd-12) | 0.004 |
| Solvent (Solv-3) | 0.16 |
| Solvent (Solv-2) | 0.16 |
| Second Layer (Color-mix preventing layer) | |
| Gelatin | 0.99 |
| Color mix inhibitor (Cpd-5) | 0.11 |
| Color mix inhibition-strengthening agent (Cpd-13) | 0.02 |
| Ultraviolet-absorber (UV-1) | 0.10 |
| Solvent (Solv-1) | 0.25 |
| Solvent (Solv-4) | 0.25 |
| Third Layer (Green-sensitive emulsion layer) | |
| Silver chlorobromide emulsions (cubic grains, 1:3 (Ag mol ratio) blend of large size emulsion B having average grain size of 0.55 μm and small size emulsion B having average grain size of 0.39 μm, whose deviation coefficient of grain size distribution is 0.10 and 0.08, respectively, each in which 0.8 mol % of AgBr was located at the surface of grains) | 0.12 |
| Gelatin | 1.63 |

-continued

| | |
|---|---|
| Magenta coupler (See TABLE 1) | 0.18 |
| Image-dye stabilizer (Cpd-2) | 0.06 |
| Image-dye stabilizer (Cpd-3) | 0.16 |
| Image-dye stabilizer (Cpd-4) | 0.03 |
| Image-dye stabilizer (Cpd-9) | 0.02 |
| Image-dye stabilizer (Cpd-14) | 0.001 |
| Solvent (Solv-4) | 0.36 |
| Fourth Layer (Color mix preventing layer) | |
| Gelatin | 0.70 |
| Color-mix inhibitor (Cpd-5) | 0.07 |
| Color-mix inhibition-strengthening agent (Cpd-13) | 0.01 |
| Ultraviolet-absorber (UV-1) | 0.07 |
| Solvent (Solv-1) | 0.18 |
| Solvent (Solv-4) | 0.18 |
| Fifth Layer (Red-sensitive emulsion layer) | |
| Silver chlorobromide emulsions (cubic grains, 1:4 (Ag mol ratio) blend of large size emulsion C having average grain size of 0.58 μm and small size emulsion C having average grain size of 0.45 μm, whose deviation coefficient of grain size distribution is 0.09 and 0.11, respectively, each in which 0.6 mol % of AgBr was located at the surface of grains) | 0.23 |
| Gelatin | 1.14 |
| Cyan coupler (E × C) | 0.36 |
| Image-dye stabilizer (Cpd-2) | 0.006 |
| Image-dye stabilizer (Cpd-6) | 0.20 |
| Image-dye stabilizer (Cpd-7) | 0.40 |
| Image-dye stabilizer (Cpd-8) | 0.25 |
| Image-dye stabilizer (Cpd-14) | 0.01 |
| Solvent (Solv-6) | 0.24 |
| Sixth layer (Ultraviolet ray absorbing layer) | |
| Gelatin | 0.45 |
| Ultraviolet absorber (UV-2) | 0.45 |
| Solvent (Solv-5) | 0.02 |
| Seventh layer (Protective layer) | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture ((a):(b) = 1:1 in molar ratio) of

-continued
(a) R = 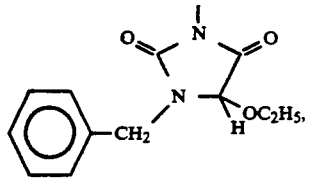 X = Cl; (b) R = 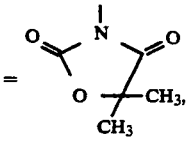 X = $OCH_3$
of the following formula
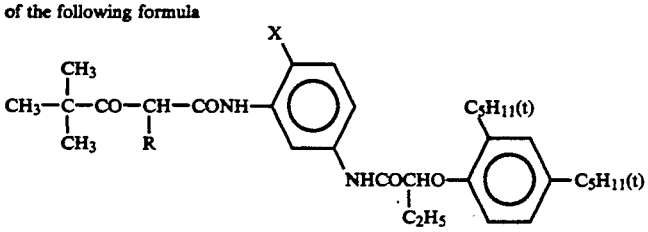
(ExC) Cyan coupler
Mixture (1:1:1 in molar ratio) of
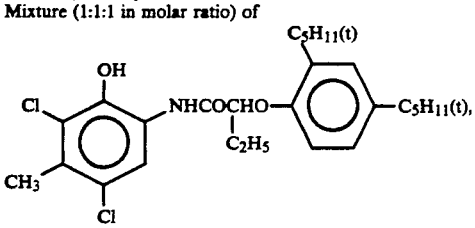
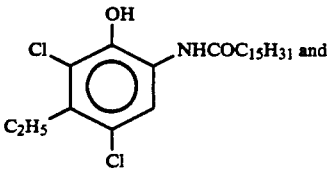
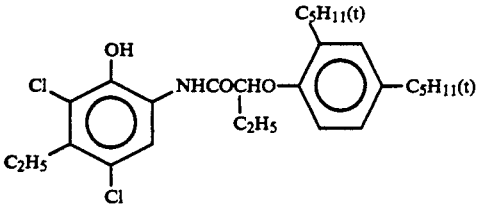
(Cpd-1) Image-dye stabilizer
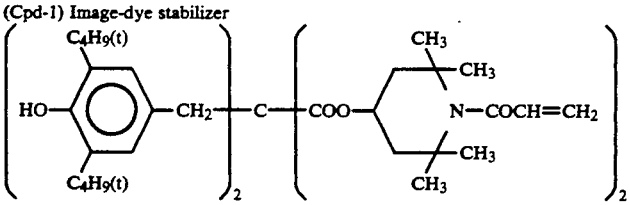
(Cpd-2) Image-dye stabilizer
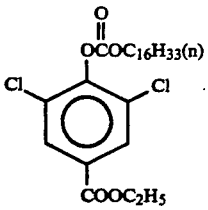
(Cpd-3) Image-dye stabilizer
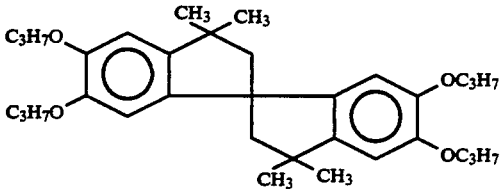
(Cpd-4) Image-dye stabilizer
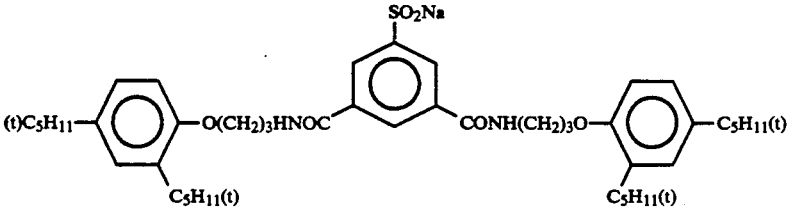

-continued
(Cpd-5) Color-mix inhibitor
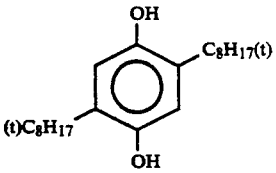
(Cpd-6) Image-dye stabilizer
Mixture (2:4:4 in weight ratio) of
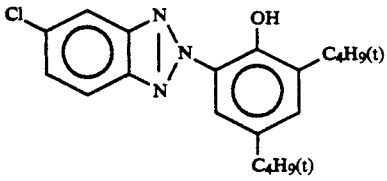
and
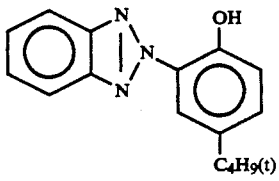
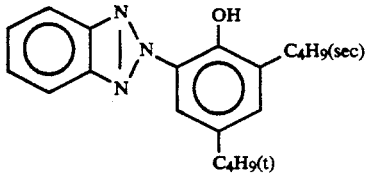
(Cpd-7) Image-dye stabilizer
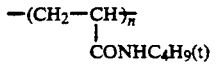
Average molecular weight: 60,000
(Cpd-8) Image-dye stabilizer
Mixture (1:1 in weight ratio) of
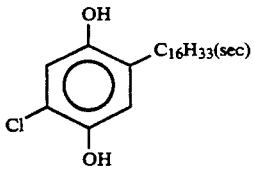
and
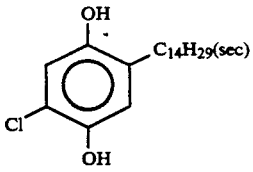
(Cpd-9) Image-dye stabilizer
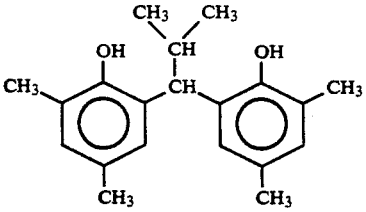
(Cpd-10) Antiseptic
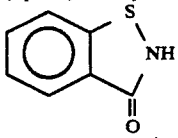
(Cpd-11) Antiseptic
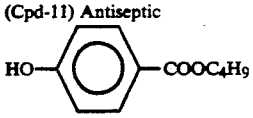
(Cpd-12)
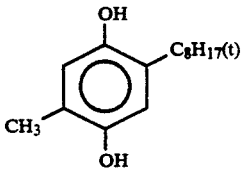
(Cpd-13)
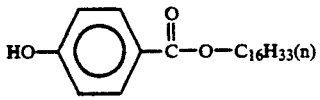
(Cpd-14)
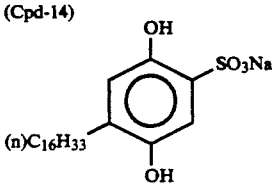

-continued (UV-1) Ultraviolet ray absorber
Mixture (4:2:4 in weight ratio) of

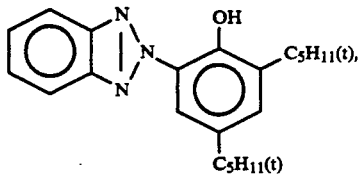

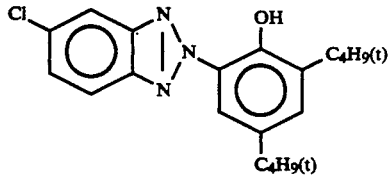

and

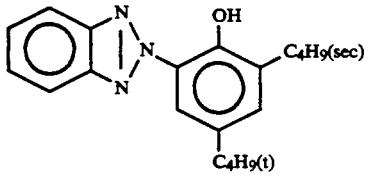

(Solv-1) Solvent

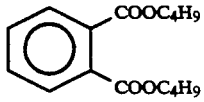

(Solv-2) Solvent

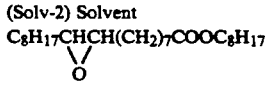

(Solv-3) Solvent

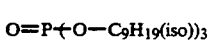

(Solv-4) Solvent

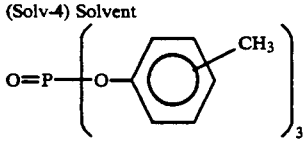

(Solv-5) Solvent

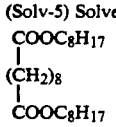

(Solv-6) Solvent
Mixture (80:20 in volume ratio) of

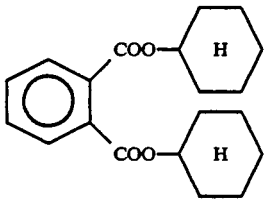

and

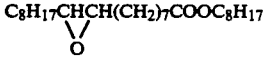

First, each of samples was subjected to a gradation exposure to light through a three color separated filter for sensitometry using a sensitometer (FWH model made by Fuji Photo Film Co., Ltd., the color temperature of light source was 3200° K.). At that time, the exposure was carried out in such a manner that the exposure amount was 250 CMS with the exposure time being 0.1 sec.

After exposure to light, each sample was subjected to a continuous processing (running test) according to the processing process shown below by using a paper processor, until the replenishing amount reached to twice the tank volume of color developer.

| Processing step | Temperature | Time | Replenisher* | Tank Volume |
|---|---|---|---|---|
| Color developing | 35° C. | 45 sec | 161 ml | 17 liter |
| Bleach-fixing | 30–35° C. | 45 sec | 215 ml | 17 liter |
| Rinse (1) | 30–35° C. | 20 sec | — | 10 liter |
| Rinse (2) | 30–35° C. | 20 sec | — | 10 liter |
| Rinse (3) | 30–35° C. | 20 sec | 350 ml | 10 liter |
| Drying | 70–80° C. | 60 sec | | |

Note: *Replenisher amount per $m^2$ of photographic material.
Rinse steps were carried out in 3-tanks countercurrent mode from the tank of rinse (3) toward the tank of rinse (1).

The composition of each processing solution is as followed, respectively:

| | Tank Solution | Replenisher |
|---|---|---|
| Color-developer | | |
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-Bis(carboxymethyl)hydrazine | 4.0 g | 5.0 g |
| Monosodium N,N-di(sulfoethyl)-hydroxylamine | 4.0 g | 5.0 g |
| Fluorescent whitening agent (WHITEX-4B, made by Sumitomo Chemical Ind.) | 1.0 g | 2.0 g |
| Water to make | 1000 ml | 1000 ml |
| pH | 10.05 | 10.45 |
| Bleach-fixing solution | | |
| (Both tank solution and replenisher) | | |
| Water | 400 ml | |
| Ammonium thiosulfate (70%) | 100 ml | |
| Sodium sulfite | 17 g | |
| Iron (III) ammonium ethylenediamine-tetraacetate | 55 g | |
| Disodium ethylenediaminetetraacetate | 5 g | |

-continued

| | Tank Solution | Replenisher |
|---|---|---|
| Ammonium bromide | 40 g | |
| Water to make | 1000 ml | |
| pH | 6.0 | |
| Rinse solution | | |
| (Both tank solution and replenisher) Ion-exchanged water (calcium and magnesium each are 3 ppm or below) | | |

Samples (2) to (25) were prepared in the same manner as Sample (1), except that the coupler and high-boiling organic solvent in the third layer (green-sensitive emulsion layer), and the sixth layer (ultraviolet ray absorbing layer) were changed in accordance with Table 1.

The emulsified dispersion of lipophilic fine particles in which a UV-absorber and a hydrophobic polymer are present together in same particle of the present invention was prepared as follows: 750 g of UV-absorber, 350 g (or 467 g) of organic solvent-soluble and hydrophobic polymer of the present invention, 34 g of high-boiling organic solvent (Solv-5), and 60 g of dodecylbenzenesulfonic acid were dissolved in 1,600 ml of ethyl acetate, the resulting solution was emulsified and dispersed in 5,000 f of 20% gelatin solution, and then water was added to make total weight of 12,000 g. The average particle size of thus-prepared hydrophilic particles was 0.05 to 0.12 μm.

TABLE 1

| | Third layer (Green-sensitive emulsion layer) | | | | | Sixth layer (UV-absorbing layer) | | | First layer (Blue-sensitive emulsion layer) | | |
|---|---|---|---|---|---|---|---|---|---|---|---|
| Sample No. | Magenta coupler | g/m² | High-boiling organic solvent (oil) | g/m² | Ratio of oil/coupler | UV-absorber | Polymer | g/m² | Additive | g/m² | Remarks |
| (1) | I-7 | 0.18 | S-4 | 0.36 | 2.0 | UV-2 | — | | — | | For comparison |
| (2) | I-7 | 0.18 | S-4 | 0.69 | 3.8 | " | — | | — | | For comparison |
| (3) | I-7 | 0.18 | S-4 | 0.85 | 4.7 | " | — | | — | | For comparison |
| (4) | I-7 | 0.18 | S-4 | 0.36 | 6.2 | " | — | | — | | For comparison |
| (5) | I-7 | 0.18 | S-4 | 0.36 | 2.0 | " | P-17 | 0.21 | — | | For comparison |
| (6) | I-7 | 0.18 | S-4 | 0.69 | 3.8 | " | P-17 | 0.21 | — | | For comparison |
| (7) | I-7 | 0.18 | S-4 | 0.76 | 4.2 | " | P-17 | 0.21 | — | | For comparison |
| (8) | I-7 | 0.18 | S-4 | 0.85 | 4.7 | " | P-17 | 0.21 | — | | This invention |
| (9) | I-7 | 0.18 | S-4 | 0.92 | 5.1 | " | P-17 | 0.21 | — | | This invention |
| (10) | I-7 | 0.18 | S-4 | 1.03 | 5.7 | " | P-17 | 0.21 | — | | This invention |
| (11) | I-7 | 0.18 | S-4 | 1.12 | 6.2 | " | P-17 | 0.21 | — | | For comparison |
| (12) | I-7 | 0.18 | S-4 | 0.92 | 5.1 | " | P-17 | 0.21 | IV-2 | 0.20 | This invention |
| (13) | I-7 | 0.18 | S-10 | 0.92 | 5.1 | " | P-17 | 0.21 | IV-2 | 0.20 | This invention |
| (14) | I-7 | 0.18 | S-9 | 0.92 | 5.1 | UV-3 | P-17 | 0.21 | IV-2 | 0.20 | This invention |
| (15) | I-2 | 0.21 | S-10 | 0.63 | 3.0 | " | P-9 | 0.21 | — | | For comparison |
| (16) | I-2 | 0.21 | S-10 | 1.10 | 5.2 | " | P-9 | 0.21 | — | | This invention |
| (17) | I-2 | 0.21 | S-10 | 1.31 | 6.2 | " | P-9 | 0.21 | — | | For comparison |
| (18) | I-2 | 0.21 | S-10 | 1.10 | 5.2 | " | — | | — | | For comparison |
| (19) | I-2 | 0.21 | S-10 | 1.10 | 5.2 | " | — | | — | | For comparison |
| (20) | I-2 | 0.21 | S-10 | 1.10 | 5.2 | " | P-3 | 0.21 | IV-2 | 0.20 | This invention |
| (21) | I-7 | 0.18 | S-23 | 0.92 | 5.1 | " | P-7 | 0.28 | III-1 | 0.30 | This invention |
| (22) | I-13 | 0.20 | S-7 | 1.00 | 5.0 | " | P-16 | 0.28 | V-1 | 0.20 | This invention |
| (23) | I-7 | 0.18 | S-24 | 0.92 | 5.1 | " | P-19 | 0.21 | IV-1 | 0.20 | This invention |
| (24) | MM-1 | 0.18 | S-4 | 0.69 | 3.8 | UV-2 | P-17 | 0.21 | IV-2 | 0.20 | For comparison |
| (25) | MM-1 | 0.18 | S-4 | 0.92 | 5.1 | " | P-17 | 0.21 | IV-2 | 0.20 | For comparison |

MM-1

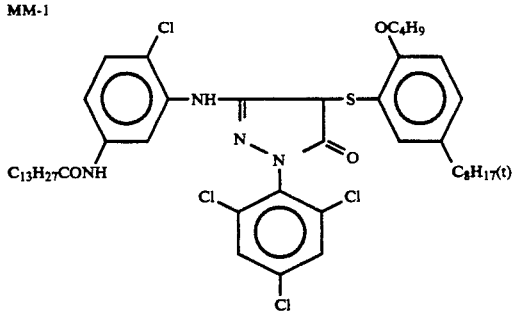

UV-2
Mixture (15:5:10:60 in weight ratio) of II-10, II-22, II-36, and II-38.
UV-3
Mixture (10:60:10:10 in weight ratio) of II-3, II-10, II-20, and II-38.

Next, tests under different conditions of light source as shown below were carried out to evaluate the light-fastness of dye image of each sample:

1) Condition A

After each sample was irradiated by sun light for 3 months in under-glass out door sun light irradiator, dye residual ratios (%) of yellow, magenta, and cyan at initial color density 1.5 were determined.

2) Condition B

After fading test of each sample under fluorescent lamp of 17,000 lux in Fade-o-meter was carried out for 3 months, dye residual ratios (%) of yellow, magenta, and cyan at initial density 1.5 were determined.

Results are shown in Table 2.

TABLE 2

| Sample | Sun light Y | Sun light M | Sun light C | Fluorescent lamp Y | Fluorescent lamp M | Fluorescent lamp C | Remarks |
|---|---|---|---|---|---|---|---|
| (1) | 14 | 24 | 16 | 15 | 36 | 15 | Comparative Example |
| (2) | 14 | 21 | 16 | 15 | 30 | 21 | Comparative Example |
| (3) | 14 | 18 | 16 | 15 | 21 | 21 | Comparative Example |
| (4) | 14 | 21 | 16 | 15 | 24 | 20 | Comparative Example |
| (5) | 12 | 21 | 10 | 13 | 25 | 11 | Comparative Example |
| (6) | 12 | 18 | 10 | 13 | 21 | 11 | Comparative Example |
| (7) | 12 | 16 | 10 | 13 | 19 | 11 | Comparative Example |
| (8) | 12 | 10 | 10 | 13 | 11 | 11 | This Invention |
| (9) | 12 | 9 | 10 | 13 | 10 | 11 | This Invention |
| (10) | 12 | 12 | 10 | 13 | 9 | 11 | This Invention |
| (11) | 12 | 16 | 10 | 13 | 13 | 11 | Comparative Example |
| (12) | 9 | 9 | 10 | 10 | 10 | 11 | This Invention |
| (13) | 10 | 9 | 10 | 10 | 11 | 10 | This Invention |
| (14) | 10 | 9 | 10 | 10 | 10 | 11 | This Invention |
| (15) | 12 | 19 | 20 | 13 | 23 | 11 | Comparative Example |
| (16) | 11 | 10 | 10 | 13 | 10 | 10 | This Invention |
| (17) | 11 | 18 | 10 | 13 | 14 | 10 | Comparative Example |
| (18) | 14 | 18 | 16 | 15 | 22 | 21 | Comparative Example |
| (19) | 12 | 10 | 10 | 13 | 11 | 11 | This Invention |
| (20) | 10 | 10 | 10 | 10 | 10 | 10 | This Invention |
| (21) | 11 | 11 | 10 | 12 | 11 | 12 | This Invention |
| (22) | 10 | 11 | 11 | 11 | 11 | 10 | This Invention |
| (23) | 9 | 10 | 10 | 10 | 10 | 10 | This Invention |
| (24) | 10 | 40 | 10 | 10 | 34 | 11 | Comparative Example |
| (25) | 10 | 37 | 10 | 10 | 33 | 11 | Comparative Example |

As is apparent from the results in Table 2, it can be understood that, by applying a combination of the method of the use of the coupler and the high-boiling organic solvent of the present invention with the method of use of the UV-absorber of the present invention, the fastness of the yellow, magenta, and cyan of the image to sunlight as well as fluorescent lamp light are well balanced and are improved remarkably.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic material containing a support having thereon photographic constitutional layers comprising a silver halide emulsion layer containing a yellow coupler, a silver halide emulsion layer containing a magenta coupler, and a silver halide emulsion layer containing a cyan coupler as well as non-photosensitive layers, which comprises (a) in said magenta coupler containing layer, at least one magenta coupler represented by formula (I) given below, the ratio of the weight (A) of the high-boiling organic solvent contained in said magenta coupler containing silver halide emulsion layer to the weight (B) of said magenta coupler (A/B) being between 4.5 and 6.0, and (b) in a non-photosensitive layer located at a position farther than the cyan coupler containing emulsion layer from the support, at least one ultraviolet absorbing agent represented by formula (II) given below and a hydrophobic polymer insoluble in water but soluble in an organic solvent and being present together in lipophilic particles prepared by a method wherein a hydrophobic liquid in which the ultraviolet-absorbing agent and the hydrophobic polymer are dissolved together is emulsified and dispersed:

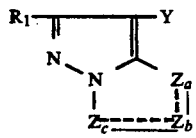

Formula (I)

wherein $R_1$ represents a hydrogen atom or a substituent, $Z_a$, $Z_b$, and $Z_c$ each represent a methine, substituted methine, =N—, or —NH—, Y represents a hydrogen atom or a group capable of being released upon a coupling reaction with the oxidized product of a developing agent, and the compound may form a dimer or higher polymer through $R_1$, Y, or $Z_a$, $Z_b$, or $Z_c$ when it is a substituted methine,

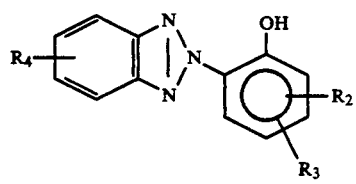

Formula (II)

wherein $R_2R_3$, and $R_4$ each represent a hydrogen atom, a halogen atom, a nitro group, a hydroxyl group, an alkyl group, an alkoxy group, an aryl group, an aryloxy group, an alkenyl group, or an acylamino group.

2. The silver halide color photographic material as claimed in claim 1, wherein said silver halide emulsion layer containing a yellow coupler contains at least one compound selected from the group consisting of sparingly water-soluble epoxy compounds represented by the following formulae (III), (IV), and (V),

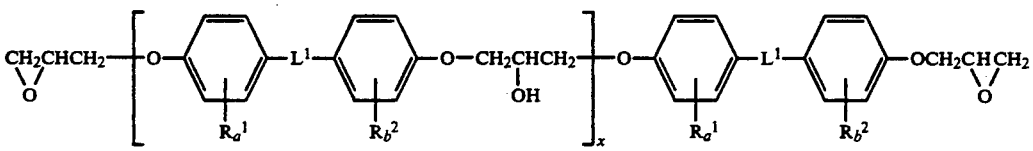

Formula (III)

-continued

Formula (IV)

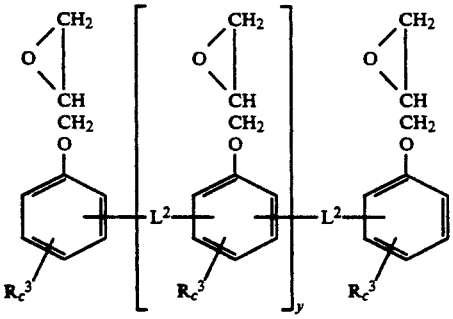

Formula (V)

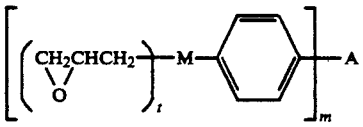

wherein $R^1$, $R^2$, and $R^3$ each represent an alkyl group or a halogen atom, $L^1$ and $L^2$ each represent a divalent aliphatic organic group, M represents an oxygen atom or a nitrogen atom, A represents a polyvalent linking group, a, b, and c each are an integer of 0 to 4, x and y each are a real number of 0 to 20, l is 1 or 2, and m is an integer of 2 to 4.

3. The silver halide color photographic material as claimed in claim 2, wherein the sparingly water-soluble epoxy compound represented by formula (III), (IV), or (V) is contained in an amount of 3 to 100% by weight to the yellow coupler.

4. The silver halide color photographic material as claimed in claim 2, wherein the sparingly water-soluble epoxy compound represented by formula (III), 5. The silver halide color photographic material as claimed in claim 1, wherein $R_4$ of formula (II) is an electron-attractive group.

6. The silver halide color photographic material as claimed in claim 1, wherein the ultraviolet-absorbing agent represented by formula (II) is liquid at room temperature.

7. The silver halide color photographic material as claimed in claim 1, wherein the ultraviolet-absorbing agent represented by formula (II) is used with other ultraviolet-absorbing agents.

8. The silver halide color photographic material as claimed in claim 1, wherein the coating amount of ultraviolet absorbing agent represented by formula (II) is 0.1 to 1.0 g per $m^2$ of the photographic material.

9. The silver halide color photographic material as claimed in claim 1, wherein the ratio of ultraviolet absorbing agent to the hydrophobic polymer is 0.1 to 20 in weight ratio.

10. The silver halide color photographic material as claimed in claim 1, wherein the ratio A/B is 4.5 to 5.8.

11. The silver halide color photographic material as claimed in claim 1, wherein the average diameter of the lipophilic particle is in the range from 0.02 to 2 μm.

12. The silver halide color photographic material as claimed in claim 1, wherein the magenta coupler represented by formula (I) is contained in an amount of 0.1 to 1.0 mol per mol of silver halide.

13. The silver halide color photographic material as claimed in claim 1, wherein the hydrophobic polymer is selected from the group consisting of poly(vinyl acetate), poly(methyl methacrylate), poly(ethyl methacrylate), poly(n-butyl methacrylate), poly(t-butyl methacrylate), poly(cyclohexyl methacrylate), poly(ethyl acrylate), poly(n-butyl acrylate), poly(t-butyl acrylate), poly(N-sec-butylacrylamide), poly(N-t-butylacrylamide), poly(N-t-butylmethacrylamide), poly(methyl vinyl ketone), polycaprolactone, polypropionlactone, polystyrene, styrene/methyl methacrylate copolymer, styrene/methyl methacrylate copolymer, styrene/ethyl methacrylate copolymer, and styrene/n-butyl methacrylate copolymer.

14. The silver halide color photographic material as claimed in claim 1, wherein the support is a reflection support.

15. The silver halide color photographic material as claimed in claim 1, wherein the coating amount of the ultraviolet-absorbing agent of the present invention contained in the nonphotosensitive layer is 0.1 to 1.0 $g/m^2$.

* * * * *